US010549559B2

(12) United States Patent
Mizutani

(10) Patent No.: US 10,549,559 B2
(45) Date of Patent: Feb. 4, 2020

(54) PRINTING APPARATUS

(71) Applicant: Brother Kogyo Kabushiki Kaisha, Nagoya-shi, Aichi-ken (JP)

(72) Inventor: Hiromitsu Mizutani, Ichinomiya (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 0 days.

(21) Appl. No.: 16/234,741

(22) Filed: Dec. 28, 2018

(65) Prior Publication Data

US 2019/0299671 A1 Oct. 3, 2019

(30) Foreign Application Priority Data

Mar. 30, 2018 (JP) ..... 2018-066401

(51) Int. Cl.
*B41J 11/70* (2006.01)
*B41J 11/66* (2006.01)
*B41J 2/32* (2006.01)

(52) U.S. Cl.
CPC ..... *B41J 11/703* (2013.01); *B41J 2/32* (2013.01); *B41J 11/663* (2013.01); *B41J 11/666* (2013.01)

(58) Field of Classification Search
CPC ... B41J 2/315; B41J 2/32; B41J 11/703; B41J 11/666; B41J 11/663; B41M 5/0052
See application file for complete search history.

(56) References Cited

U.S. PATENT DOCUMENTS

2003/0079585 A1* 5/2003 Carriere ..... B26D 1/085 83/13
2012/0027495 A1* 2/2012 Mochida ..... B41J 11/703 400/621
2013/0021622 A1* 1/2013 Yamaguchi ..... B41J 3/4075 358/1.6
2013/0064593 A1* 3/2013 Kosuge ..... B41J 11/666 400/621

FOREIGN PATENT DOCUMENTS

JP 2007-216617 A 8/2007

* cited by examiner

*Primary Examiner* — Kristal Feggins
(74) *Attorney, Agent, or Firm* — Banner & Witcoff, Ltd.

(57) ABSTRACT

A printing apparatus, including an attachment room with a passage area, a conveyer to convey a printing medium in a conveyer path, a print head, a full-cutting assembly, and a partial-cutting assembly, is provided. The passage area forms a part of the attachment room on a first side of the conveyer path in a predetermined direction. The full-cutting assembly includes a stationary piece and a full-cutting piece with a first edge movable from a position on the first side of the conveyer path toward the stationary piece on a second side of the conveyer path. The partial-cutting assembly includes a placement base and a partial cutting piece located on the second side of the conveyer path. The partial-cutting piece includes a second edge arranged to face the placement base along a movable direction of the partial-cutting piece.

14 Claims, 25 Drawing Sheets

30

| Rotation Amount Determining Table | |
|---|---|
| Tape Type | Pre-cut Rotation Amount for Ejection Roller |
| Receptor tape | Large |
| Die-cut tape | None |
| Thermosensitive tape | Large |
| Stencil Tape | Small |
| Laminated tape | Medium |
| ⋮ | ⋮ |

FIG. 24

PRINTING APPARATUS

CROSS REFERENCE TO RELATED APPLICATION

This application claims priority from Japanese Patent Application No. 2018-066401, filed on Mar. 30, 2018, the entire subject matter of which is incorporated herein by reference.

BACKGROUND

Technical Field

An aspect of the present disclosure is related to a printing apparatus capable of cutting a printing medium.

Related Art

A printing apparatus capable of cutting a printing medium is known. The printing apparatus may cut the printing medium partially in a so-called half-cutting fashion, in which the printing medium is cut partially and another part of the printing medium is left uncut, or fully in a so-called full-cutting fashion, in which the printing medium is fully separated into pieces.

SUMMARY

The printing apparatus may be equipped with a cartridge holder, a platen roller, a conveyer motor, a cutter-receiver, a half-cutting blade, and a half-cutter motor. The cartridge holder may store and hold a cartridge therein. The platen roller may convey a strip of label tape stored in the cartridge along a path by a driving force from the conveyer motor. The cutter-receiver may be arranged at a position downstream from the cartridge holder in a conveying direction to convey the label tape. The half-cutting blade may be arranged at a position to face the label tape and may be moved by the driving force from the half-cutter motor. The half-cutting blade may move from a position opposite to the cutter-receiver across the path to be closer to the cutter-receiver and partially cut the label tape, which is interposed between the cutter-receiver and the half-cutting blade in the path.

In order to provide a printing apparatus capable of cutting a tape with a larger width, the printing apparatus may be equipped with a half-cutting blade with a longer edge. The half-cutting blade with the longer edge may require a larger movable area; therefore, a volume of the printing apparatus may be increased.

The present disclosure is advantageous in that a downsized printing apparatus is provided.

According to an aspect of the present disclosure, a printing apparatus, having an attachment room, a conveyer, a print head, a full-cutting assembly, and a partial-cutting assembly, is provided. The attachment room, to which a cassette is attachable, is a deepened section in the printing apparatus and has an outlet, through which a printing medium is ejected. The attachment room has a passage area, through which the printing medium ejected outside the cassette through the outlet travels. The conveyer is configured to convey the printing medium ejected through the outlet in a conveyer path. The print head is configured to print a character on the printing medium. The full-cutting assembly is located at a position downstream with respect to the passage area in a conveying direction, which is a direction to convey the printing medium in the conveyer path. The full-cutting assembly is configured to cut the printing medium fully. The partial-cutting assembly is located at a position downstream with respect to the full-cutting assembly in the conveying direction. The partial-cutting assembly is configured to cut the printing medium partially. The passage area forms a part of the attachment room on a first side of the conveyer path in a predetermined direction, which is orthogonal to a direction of depth of the attachment room and to the conveying direction. The full-cutting assembly includes a stationary piece and a full-cutting piece. The stationary piece, on which the printing medium conveyed in the conveyer path is placed, is arranged fixedly in the full-cutting assembly on a second side of the conveyer path opposite to the first side. The full-cutting piece includes a first edge arranged to face the stationary piece. The first edge is configured to move in a first movable direction from a position on the first side of the conveyer path toward the stationary piece on the second side of the conveyer path. The partial-cutting assembly includes a placement base and a partial-cutting piece. The placement base is located on the first side of the conveyer path and is configured to place the printing medium thereon. The partial-cutting piece is movably located on the second side of the conveyer path and is configured move in a second movable direction. The partial-cutting piece includes a second edge arranged to face the placement base along the second movable direction.

According to another aspect of the present disclosure, a printing apparatus, having an attachment room, a conveyer, a print head, a full-cutting assembly, and a partial-cutting assembly, is provided. The attachment room, to which a cassette is attachable, is a deepened section in the printing apparatus and has an outlet, through which a printing medium is ejected. The attachment room has a passage area, through which the printing medium ejected outside the cassette through the outlet travels. The conveyer is configured to convey the printing medium ejected through the outlet in a conveyer path. The print head is configured to print a character on the printing medium. The full-cutting assembly is located at a position downstream with respect to the passage area in a conveying direction, which is a direction to convey the printing medium in the conveyer path. The full-cutting assembly is configured to cut the printing medium fully. The partial-cutting assembly is located at a position downstream with respect to the full-cutting assembly in the conveying direction. The partial-cutting assembly is configured to cut the printing medium partially. The passage area is located in a first sideward area in the attachment room closer to one end of the attachment room than a center of the attachment room in a predetermined direction, which is orthogonal to a direction of depth of the attachment room and to the conveying direction. The full-cutting assembly has a stationary piece and a full-cutting piece. The stationary piece, on which the printing medium conveyed in the conveyer path is placed, is arranged fixedly in the full-cutting assembly in a second sideward area in the attachment room opposite to the first sideward area in the predetermined direction across the conveyer path. The full-cutting piece includes a first edge arranged to face the stationary piece. The first edge is configured to move from a position in the first sideward area with respect to the conveyer path toward the stationary piece in the second sideward area with respect to the conveyer path. The partial-cutting assembly has a placement base and a partial-cutting piece. The placement base is located in the first sideward area with respect to the conveyer path. The placement base is configured to place the printing medium thereon. The partial-cutting piece is movably located in the second sideward area with respect to the conveyer path. The partial-cutting piece includes a second edge arranged to face the placement base along a movable direction of the partial-cutting piece.

BRIEF DESCRIPTION OF THE ACCOMPANYING DRAWINGS

Figure 5:
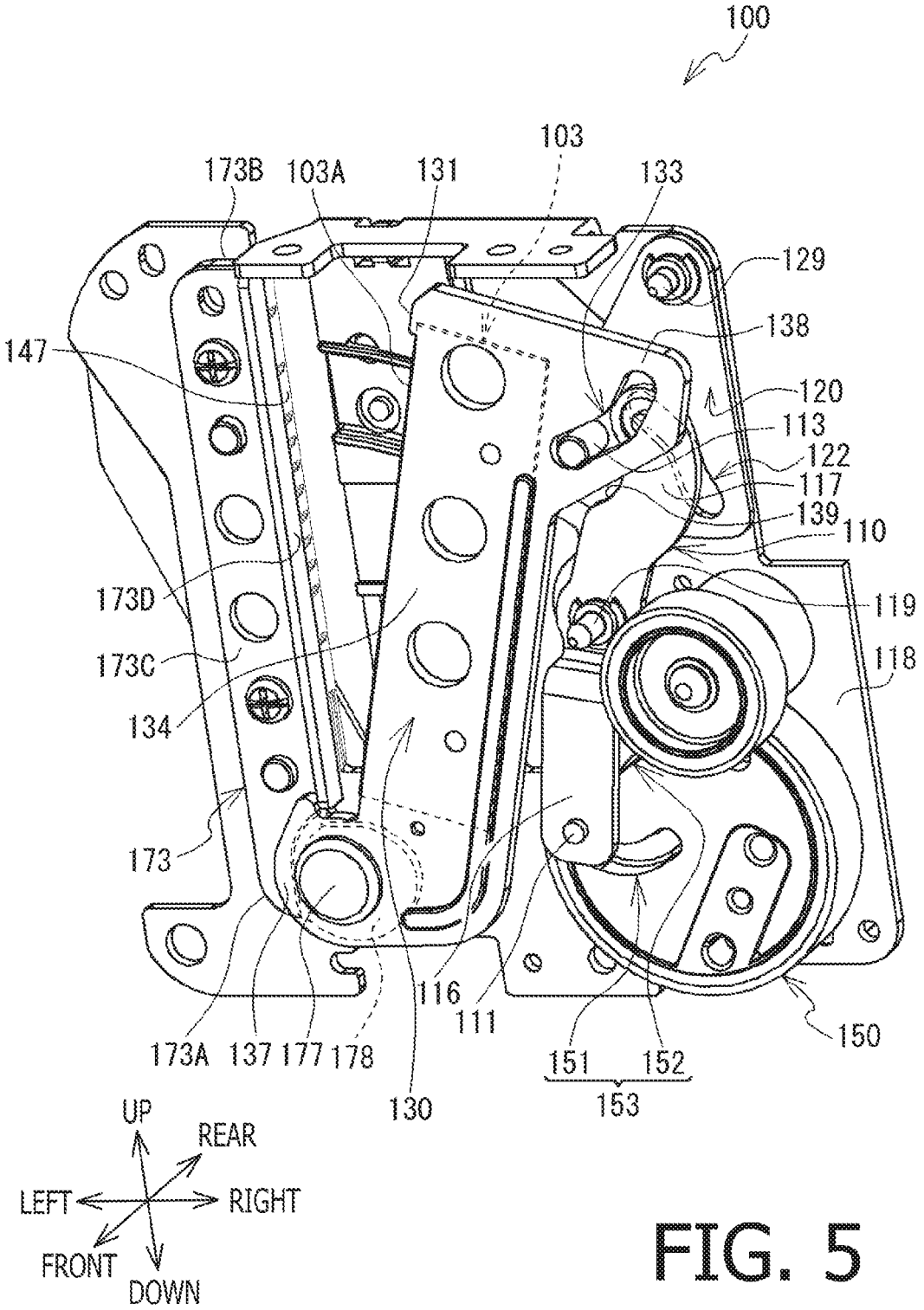

FIG. 5 is a perspective view of the cutter unit 100 in the initial condition, with a second frame 109, a motor gear 105B, and coupling gears 125, 126 being omitted, according to the embodiment of the present disclosure.

Figure 6:
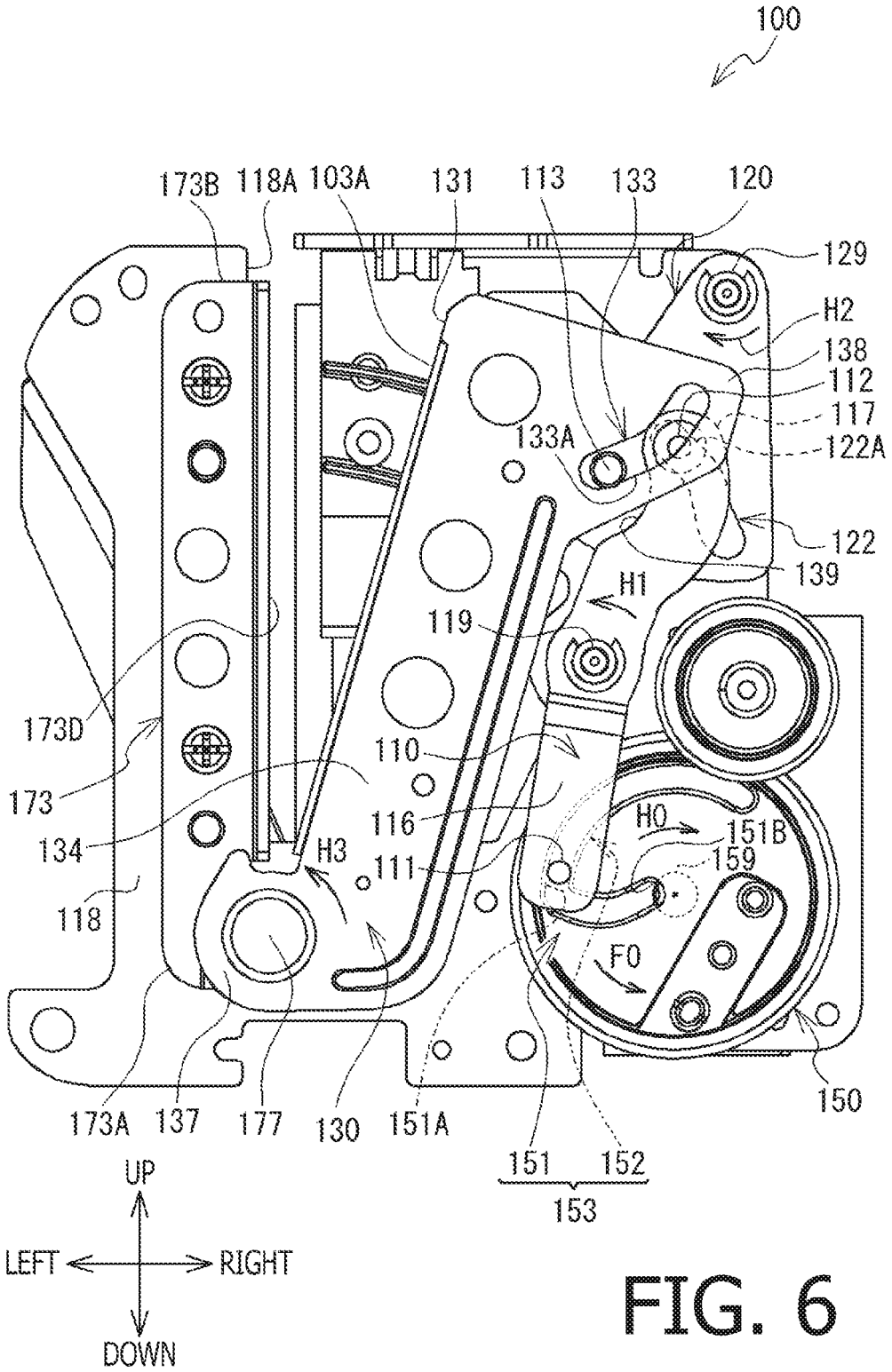

FIG. 6 is a front view of the cutter unit 100 in the initial condition according to the embodiment of the present disclosure.

Figure 7:
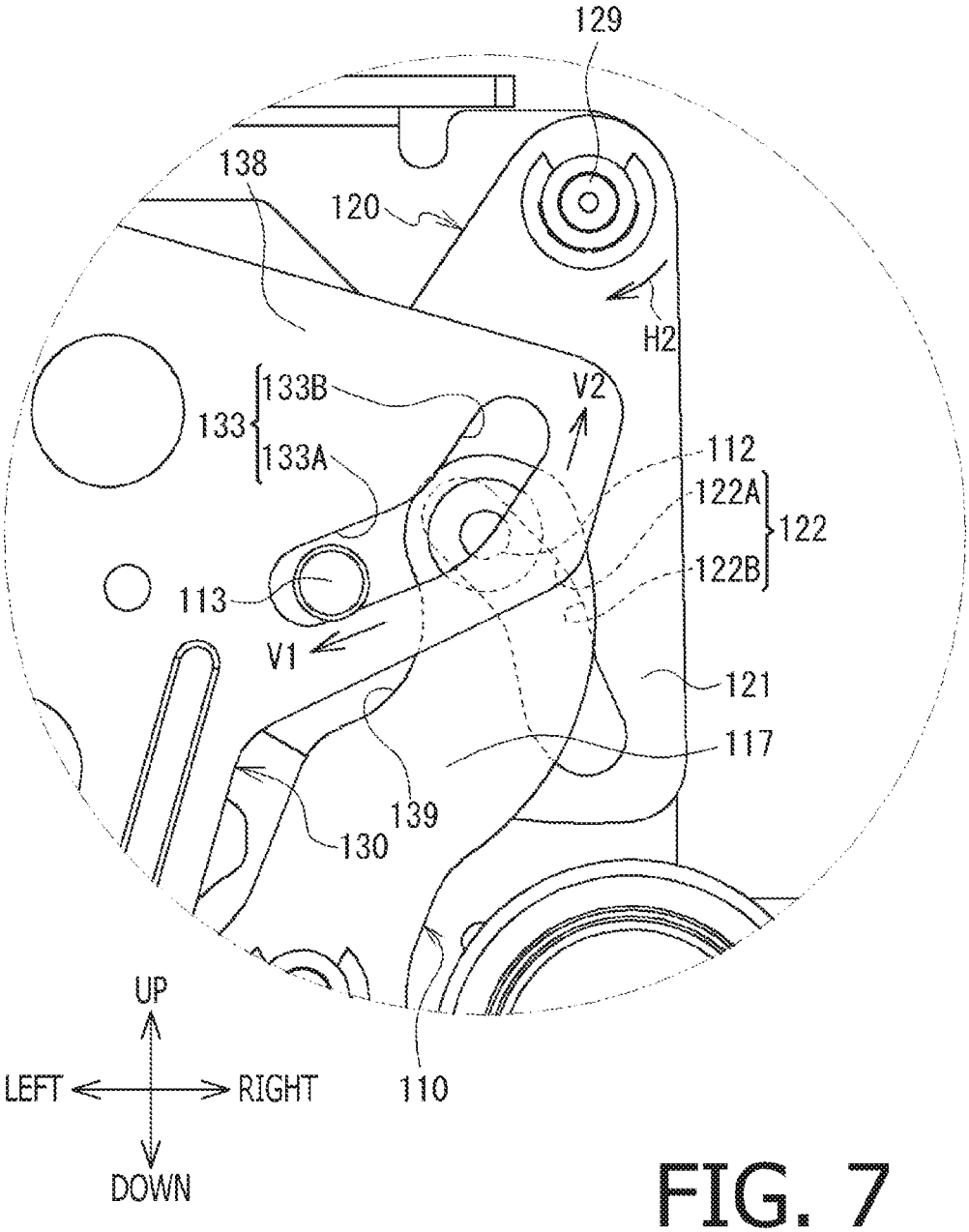

FIG. 7 is a partially enlarged view of a second link member 120 in the cutter unit 100 being in the initial condition according to the embodiment of the present disclosure.

Figure 8:
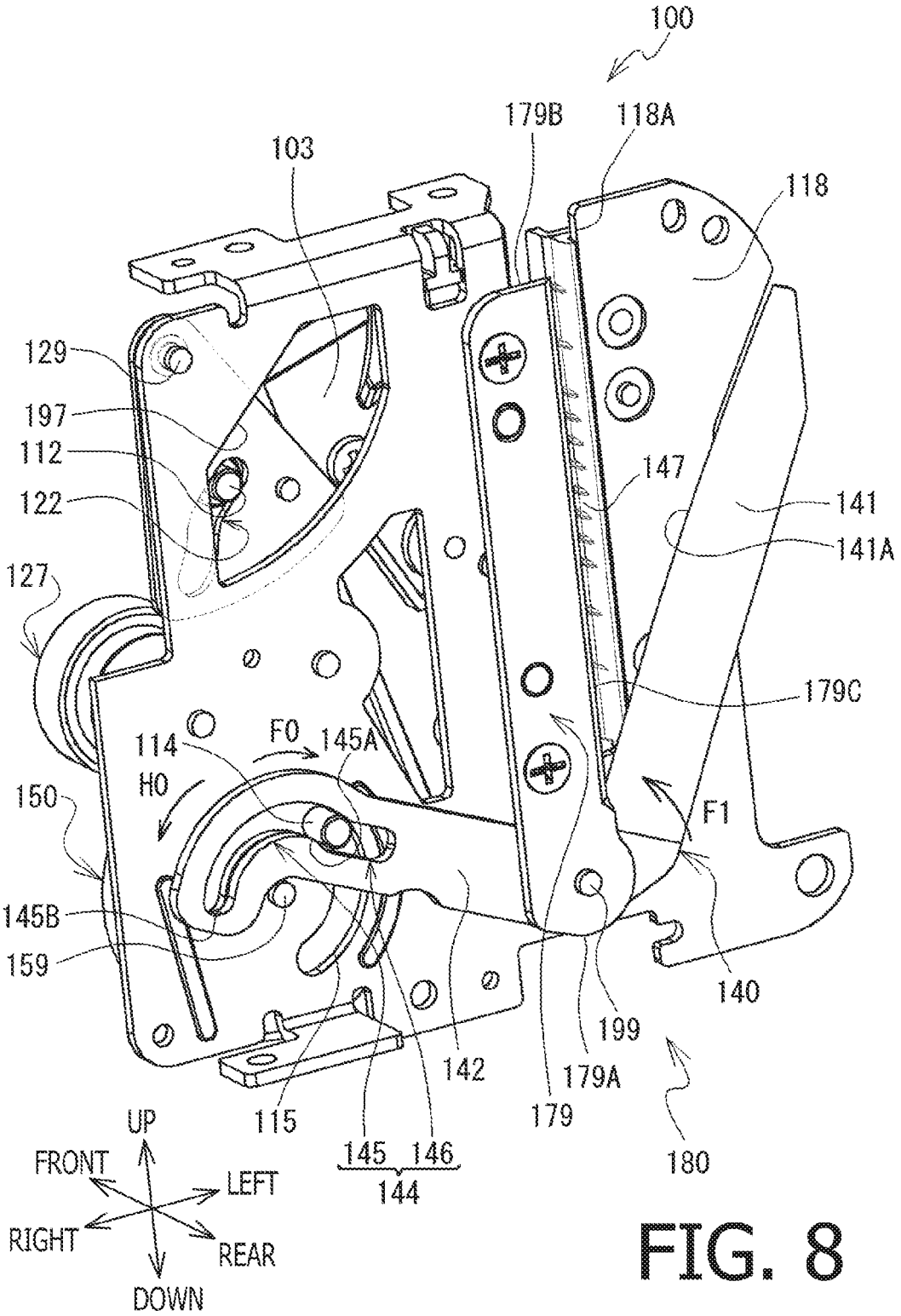

FIG. 8 is a perspective view of the cutter unit 100 with a full-cutting blade 140 being at a separated position viewed from a rightward rear and upper position according to the embodiment of the present disclosure.

Figure 9:
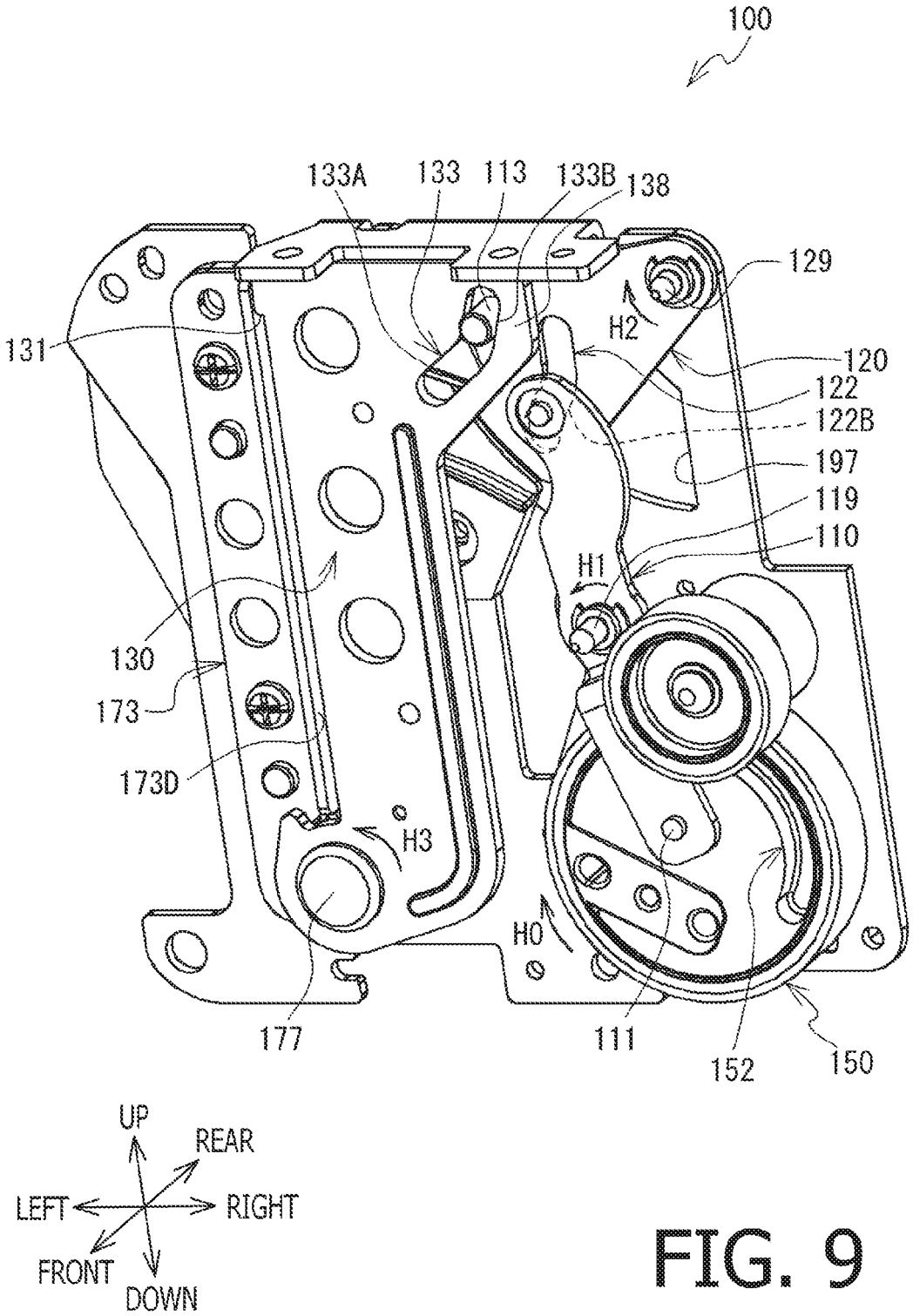

FIG. 9 is a perspective view of the cutter unit 100 during a partial-cutting action in the printing apparatus 1 viewed from a rightward frontal and upper position according to the embodiment of the present disclosure.

Figure 10:
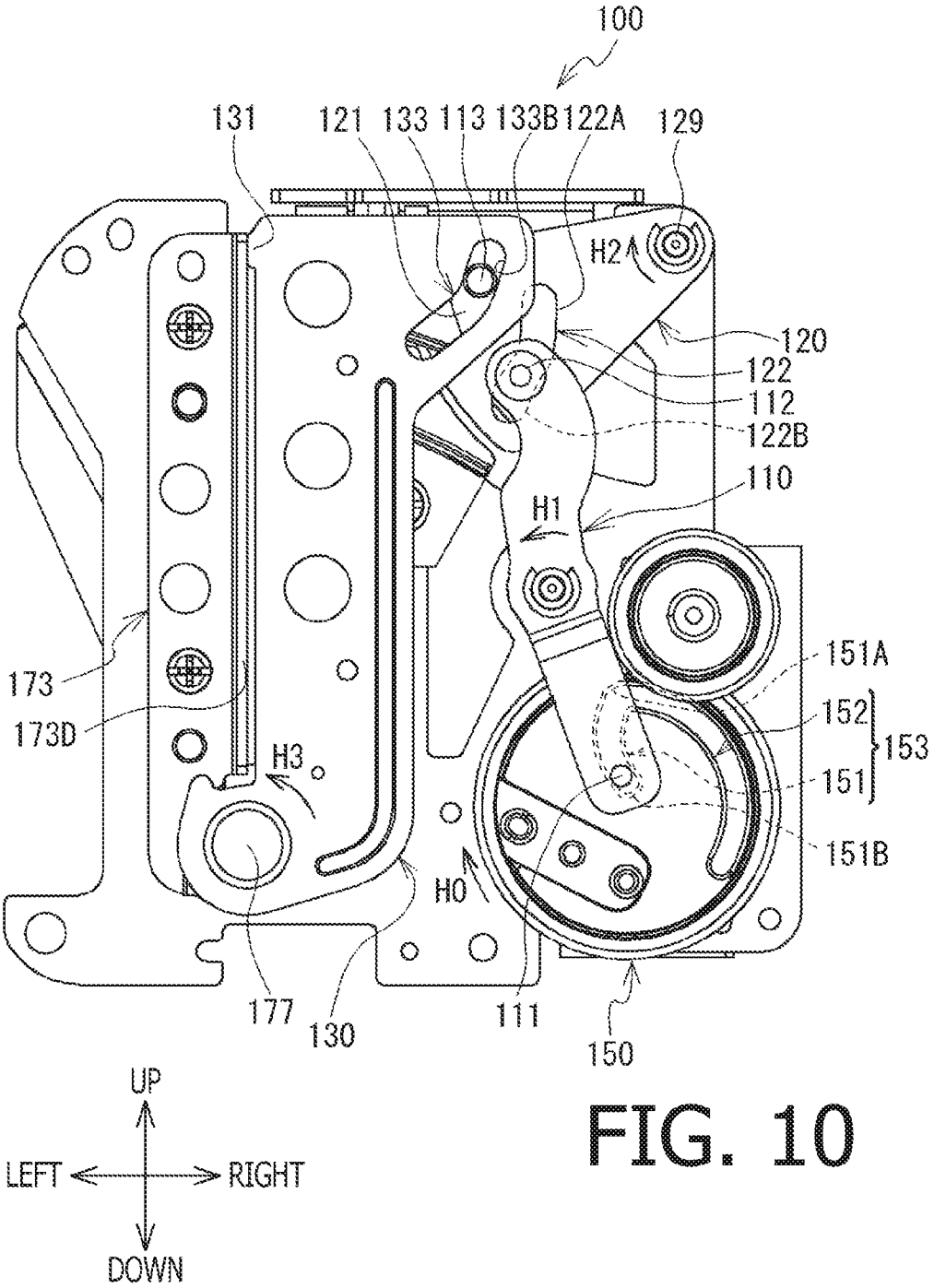

FIG. 10 is a front view of the cutter unit 100 during the partial-cutting action in the printing apparatus 1 according to the embodiment of the present disclosure.

Figure 11:
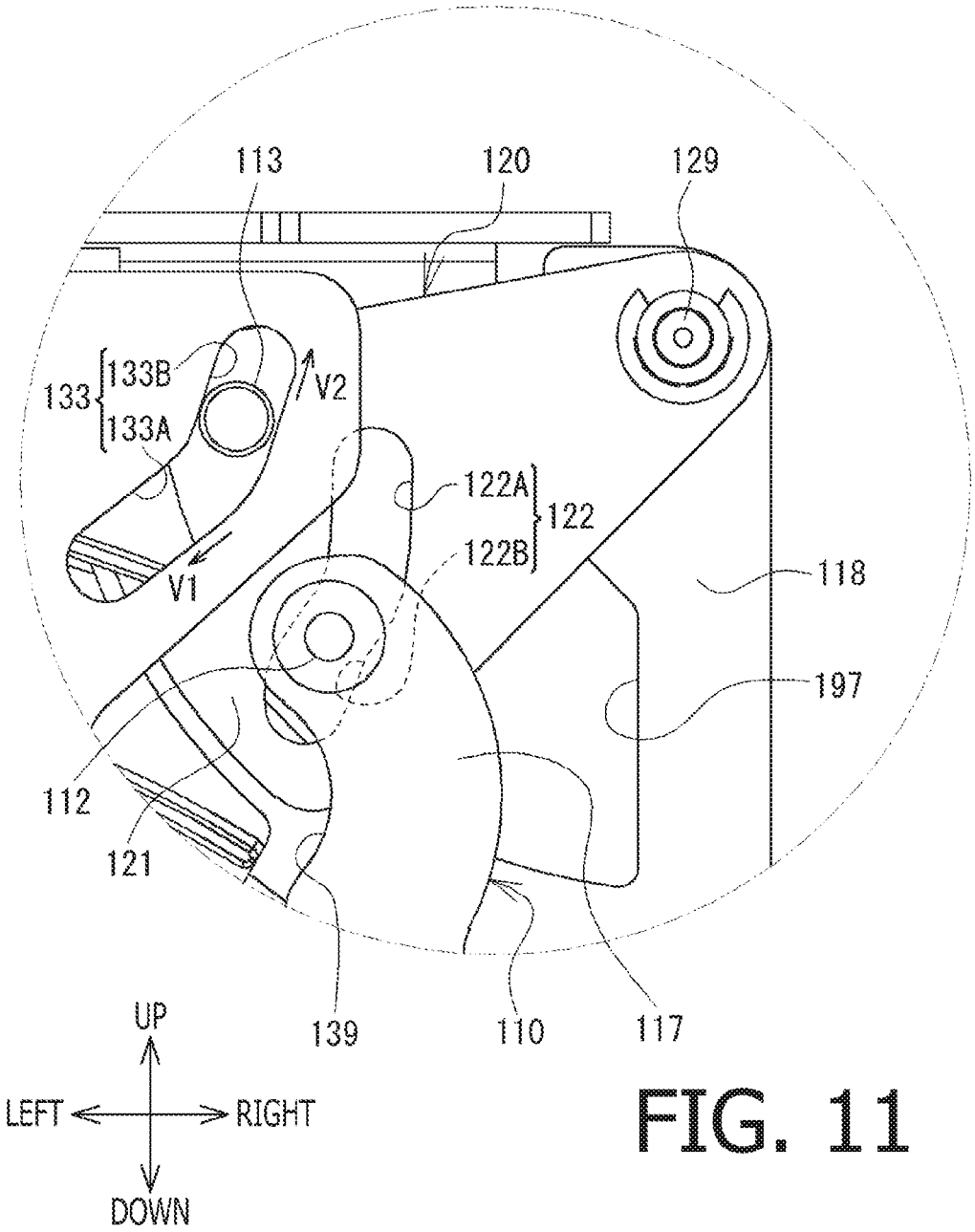

FIG. 11 is an enlarged front view of the second link member 120 in the cutter unit 100 during the partial-cutting action in the printing apparatus 1 according to the embodiment of the present disclosure.

Figure 12:
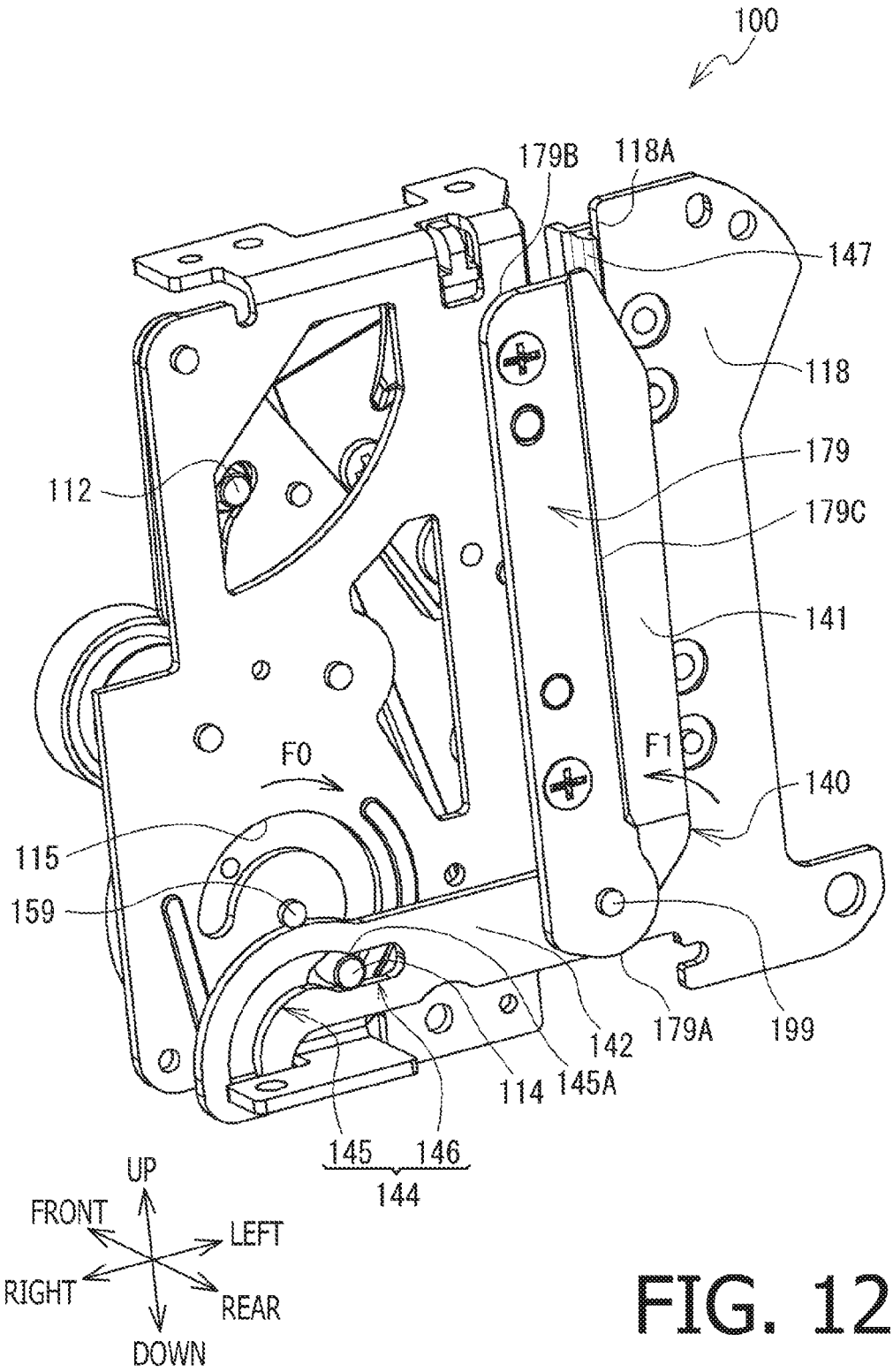

FIG. 12 is a perspective view of the full-cutting blade 140 at a full-cutting position in the cutter unit 100 viewed from a rightward rear and upper position according to the embodiment of the present disclosure.

Figure 13:
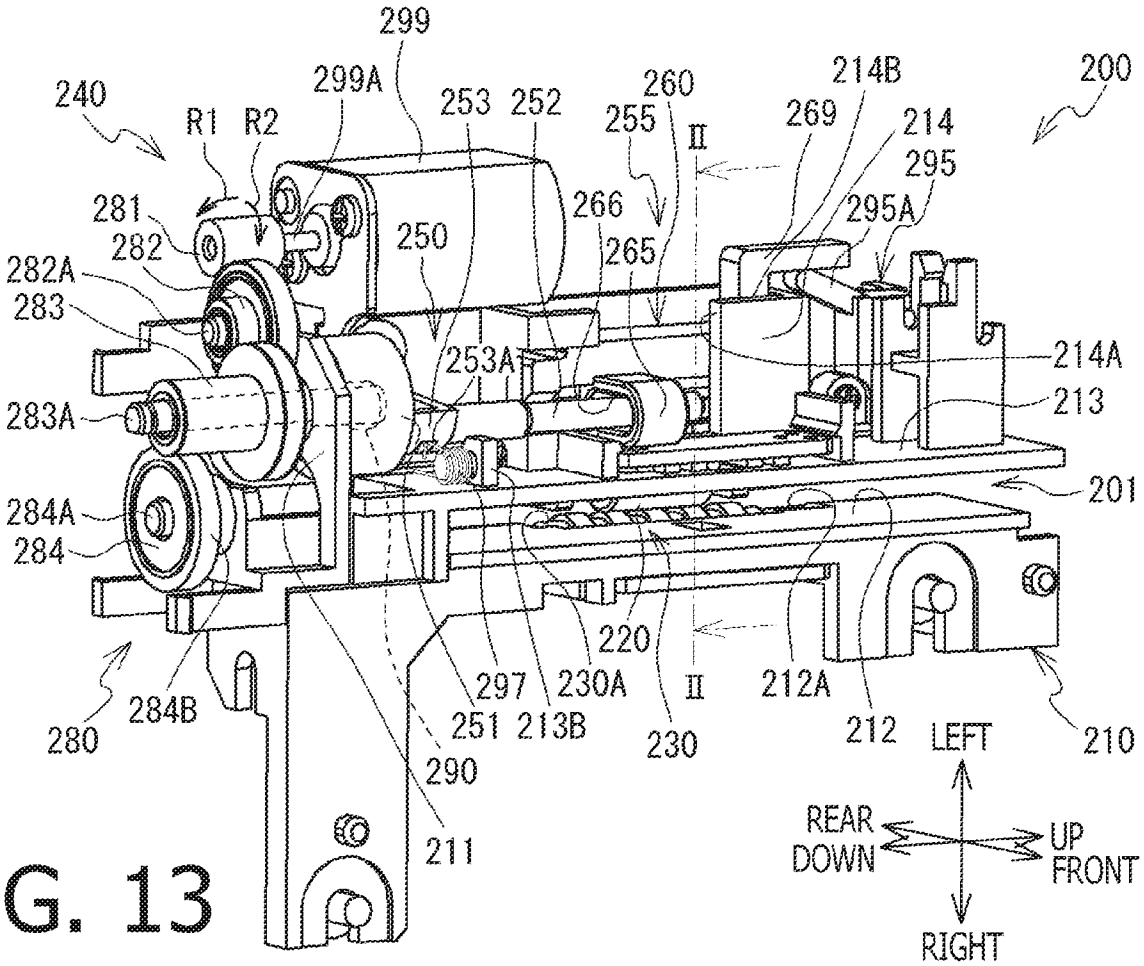

FIG. 13 is a perspective view of an ejection unit 200 when an ejection roller 220 is at a nipping position in the printing apparatus 1 viewed from a leftward frontal and lower position according to the embodiment of the present disclosure.

Figure 14:
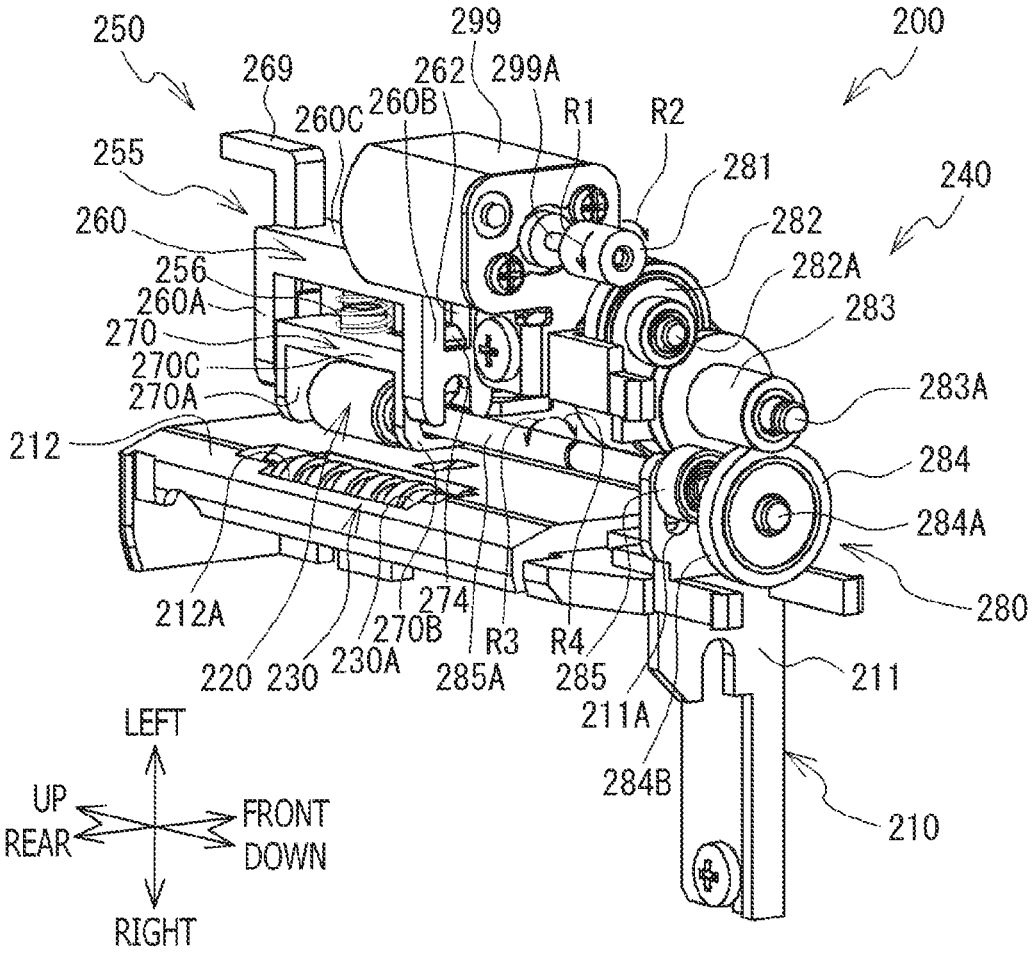

FIG. 14 is a perspective view of the ejection unit 200 when the ejection roller 220 is at a releasing position in the printing apparatus 1 according to the embodiment of the present disclosure.

Figure 15:
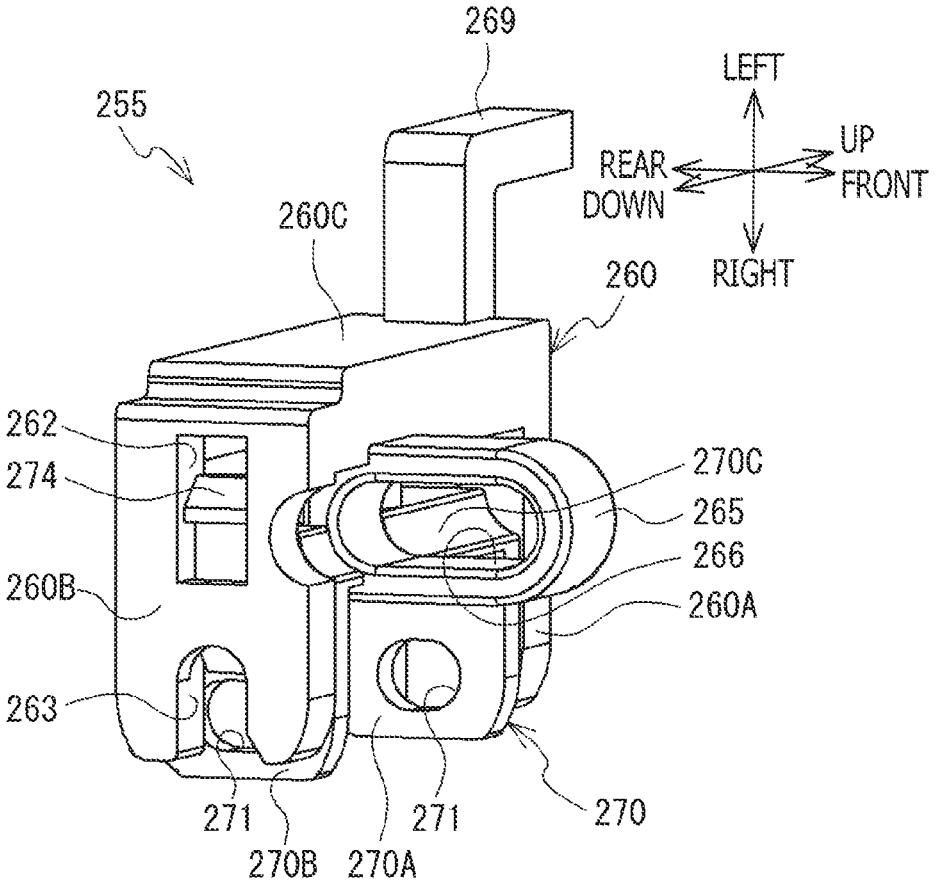

FIG. 15 is a perspective view of a roller holder 255 in the printing apparatus 1 viewed from a leftward frontal and lower position according to the embodiment of the present disclosure.

Figure 2:
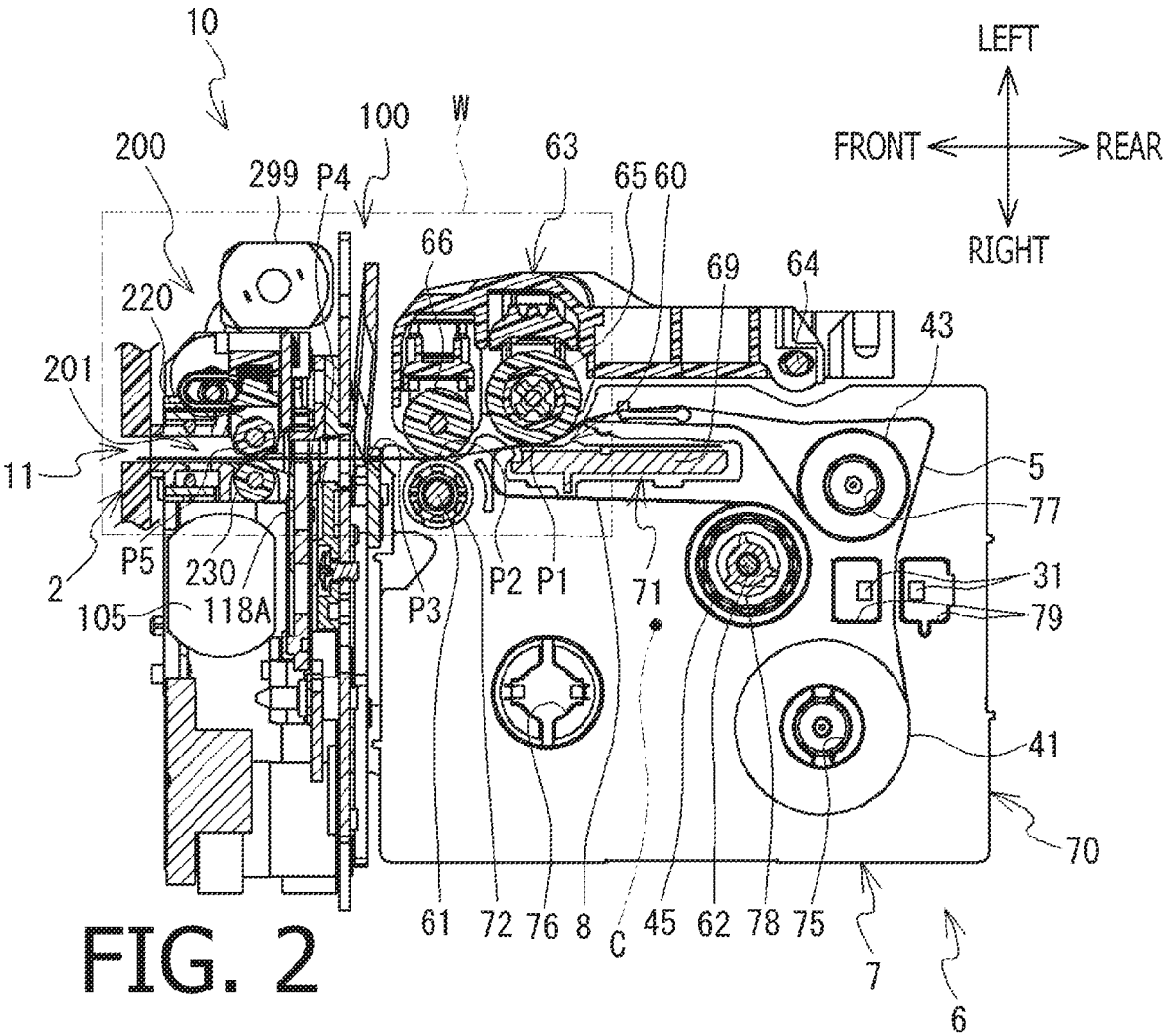
FIG. 2 is a cross-sectional view of the printing apparatus 1 according to the embodiment of the present disclosure partly taken at a line II-II shown in FIGS. 1 and 13.
Figure 16:
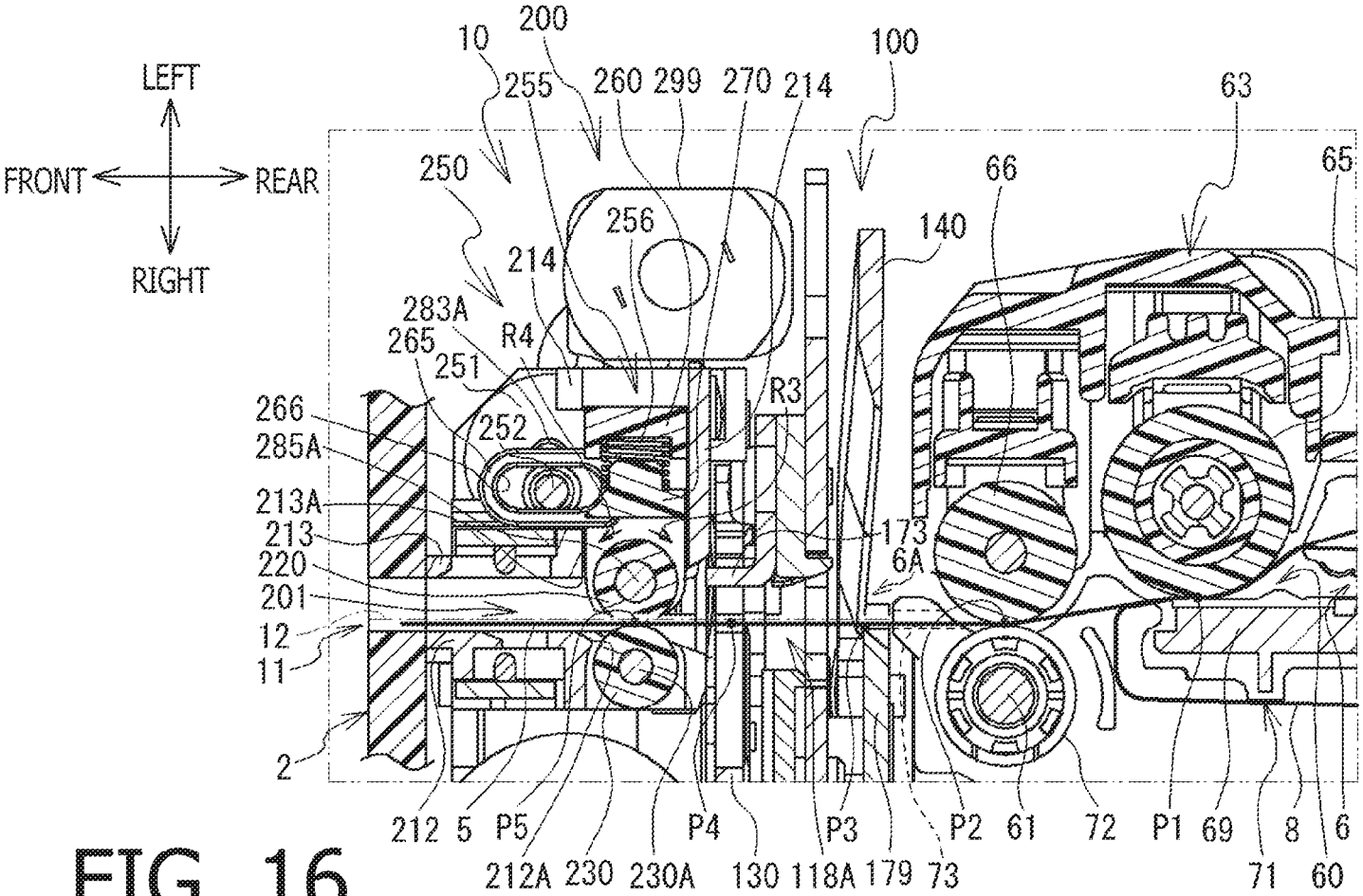

FIG. 16 is an enlarged view of an area W indicated in FIG. 2 with the ejection roller 220 located at the nipping position in the printing apparatus 1 according to the embodiment of the present disclosure.

Figure 17:
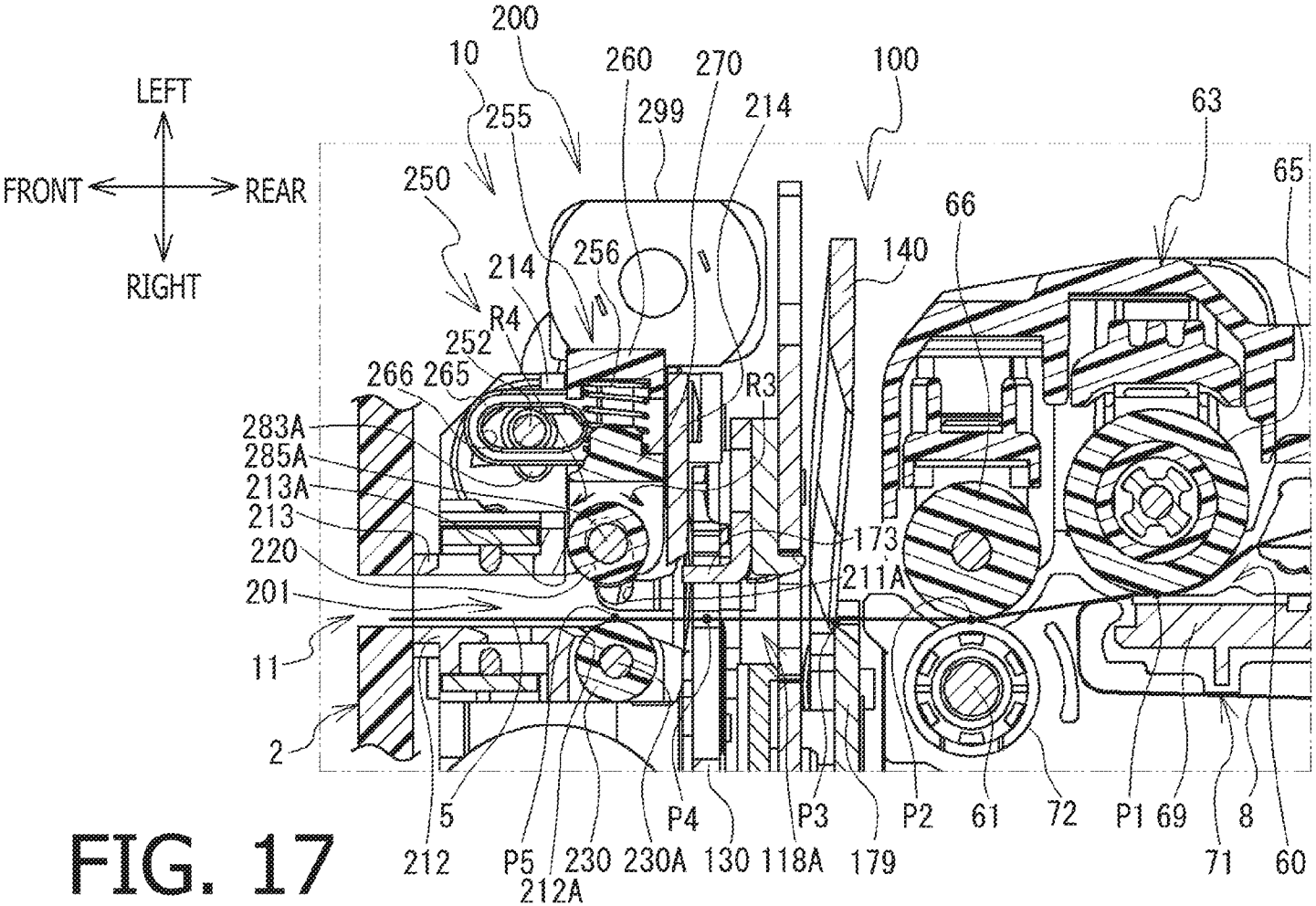

FIG. 17 is an enlarged view of the area W indicated in FIG. 2 with the ejection roller 220 located at the releasing position in the printing apparatus 1 according to the embodiment of the present disclosure.

Figure 18:
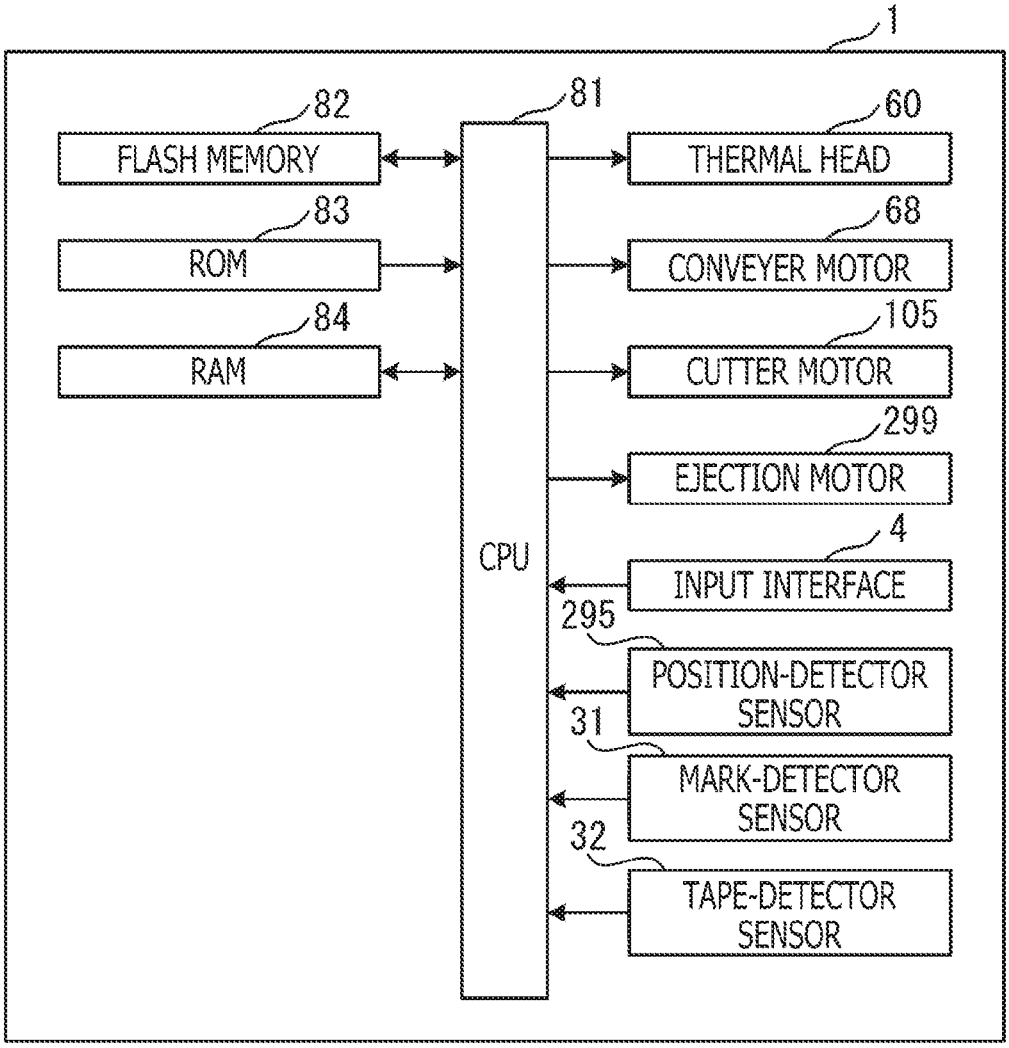

FIG. 18 is a block diagram to illustrate an electrical configuration of the printing apparatus 1 according to the embodiment of the present disclosure.

Figure 19:
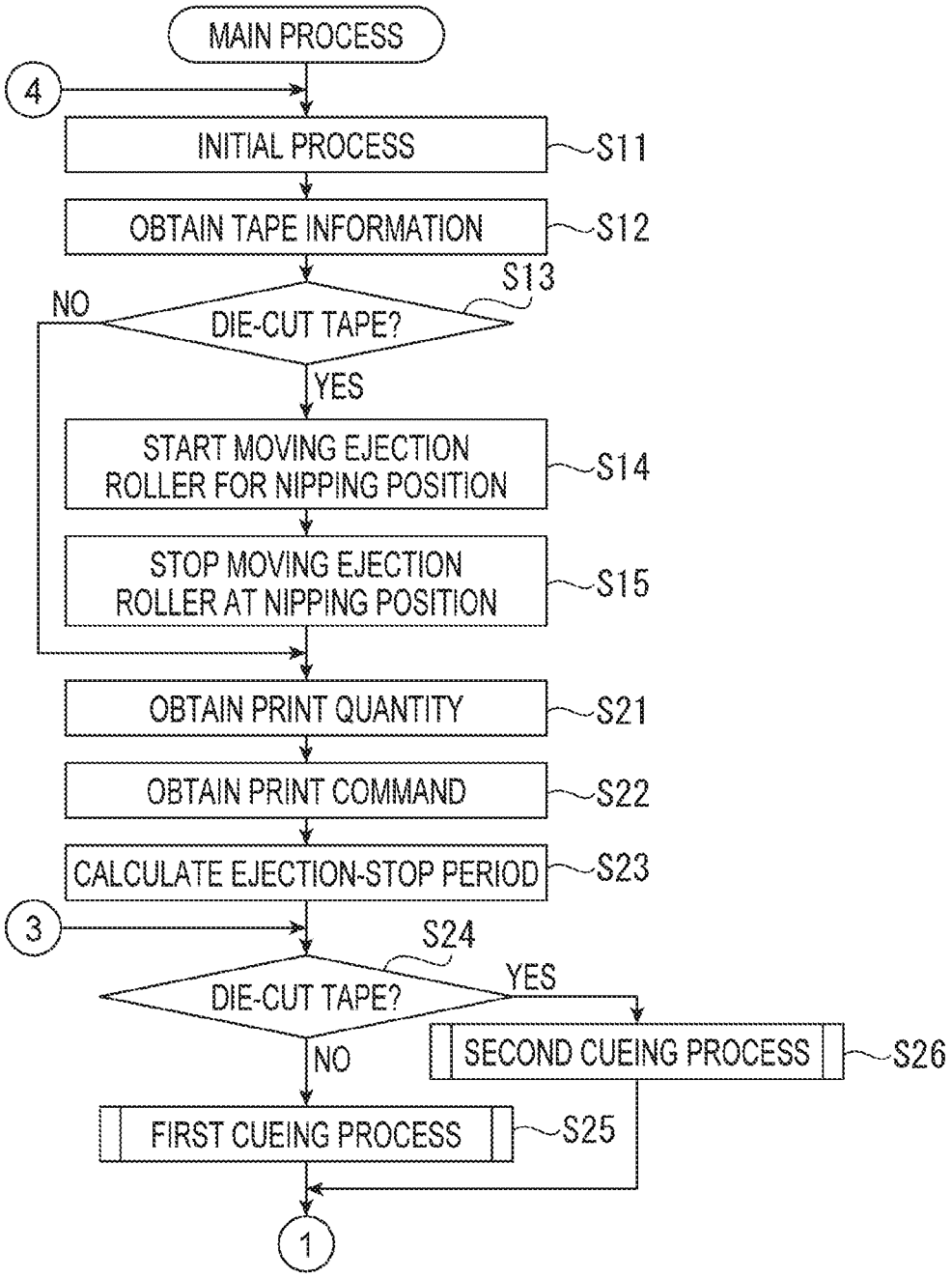

FIG. 19 is a part of a flowchart to illustrate a main process to be executed in in the printing apparatus 1 according to the embodiment of the present disclosure.

Figure 20:
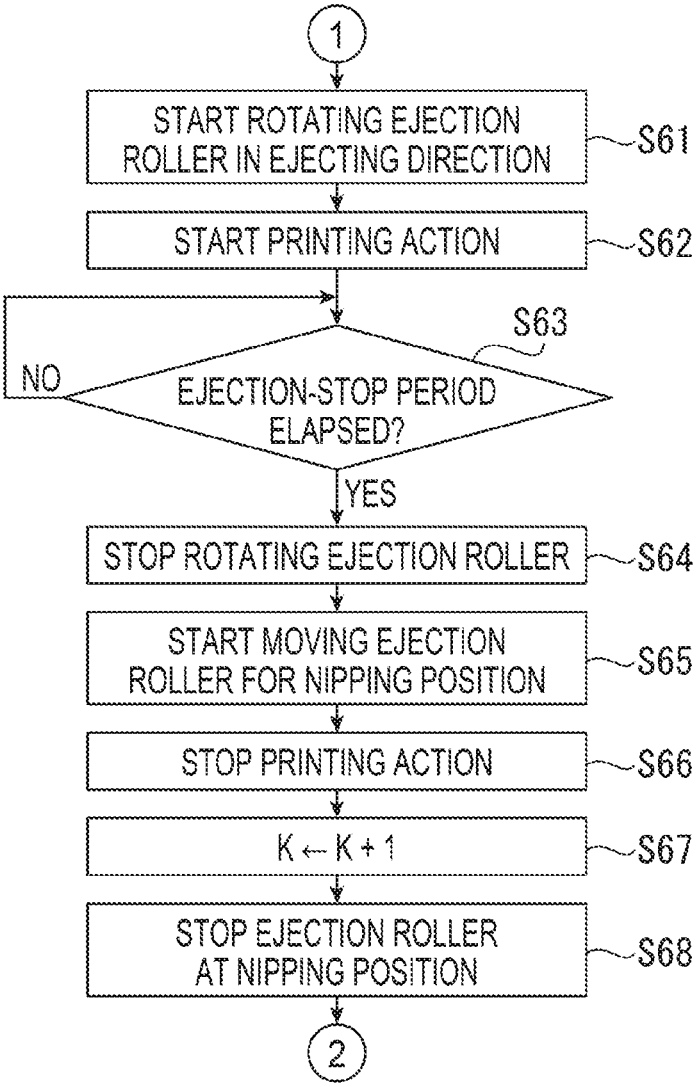

FIG. 20 is another part of the flowchart to illustrate the main process to be executed in in the printing apparatus 1 according to the embodiment of the present disclosure.

Figure 21A:
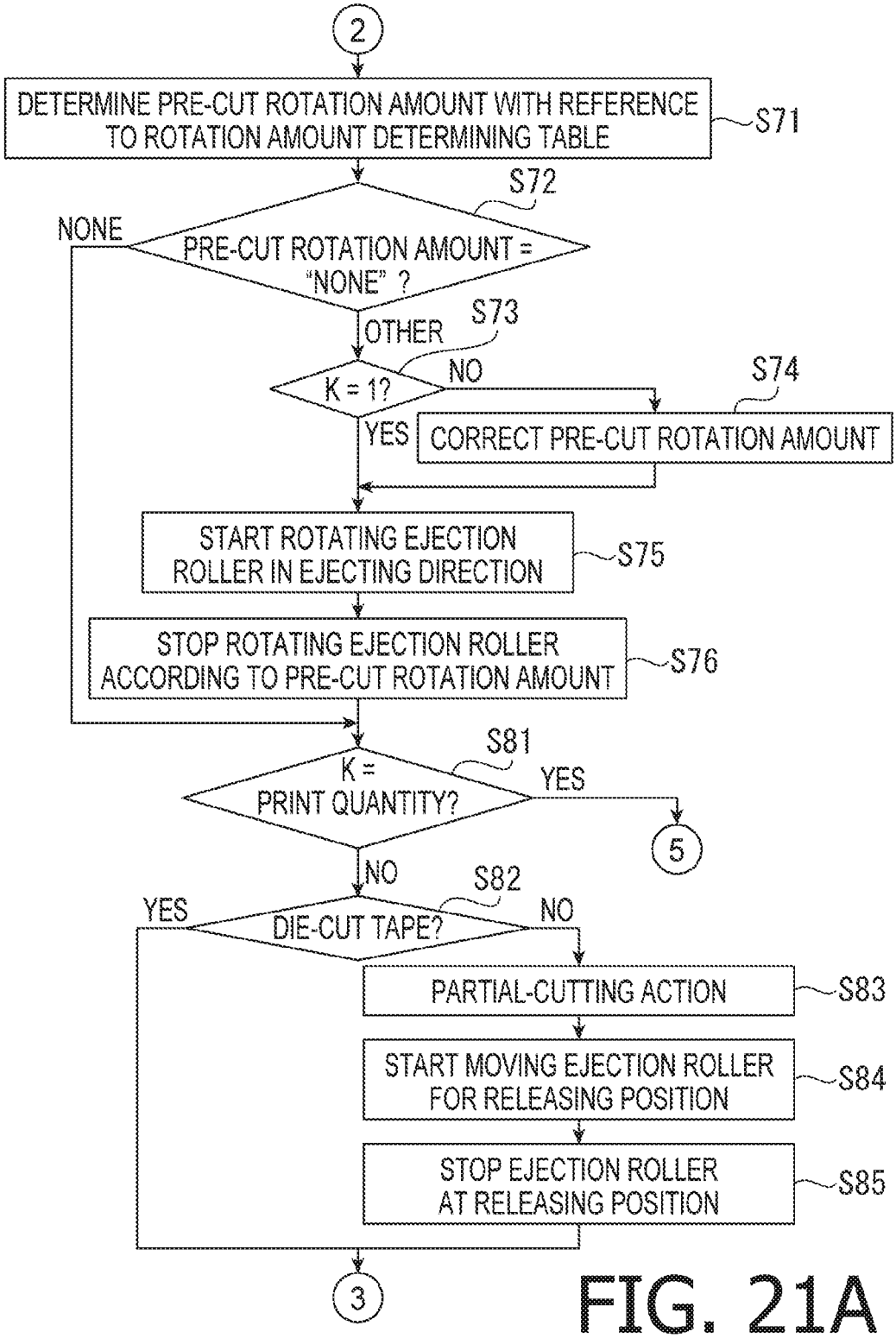
Figure 21B:
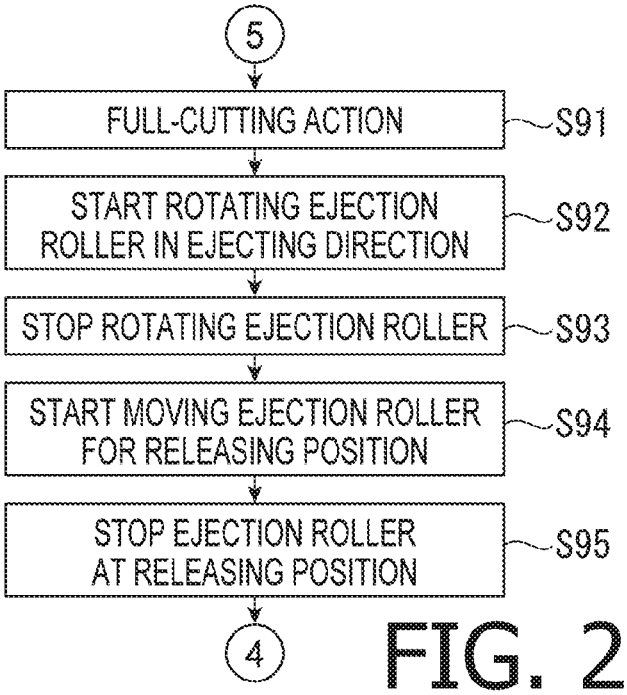

FIGS. 21A-21B are another parts of the flowchart to illustrate the main process to be executed in the printing apparatus 1 according to the embodiment of the present disclosure.

Figure 22:
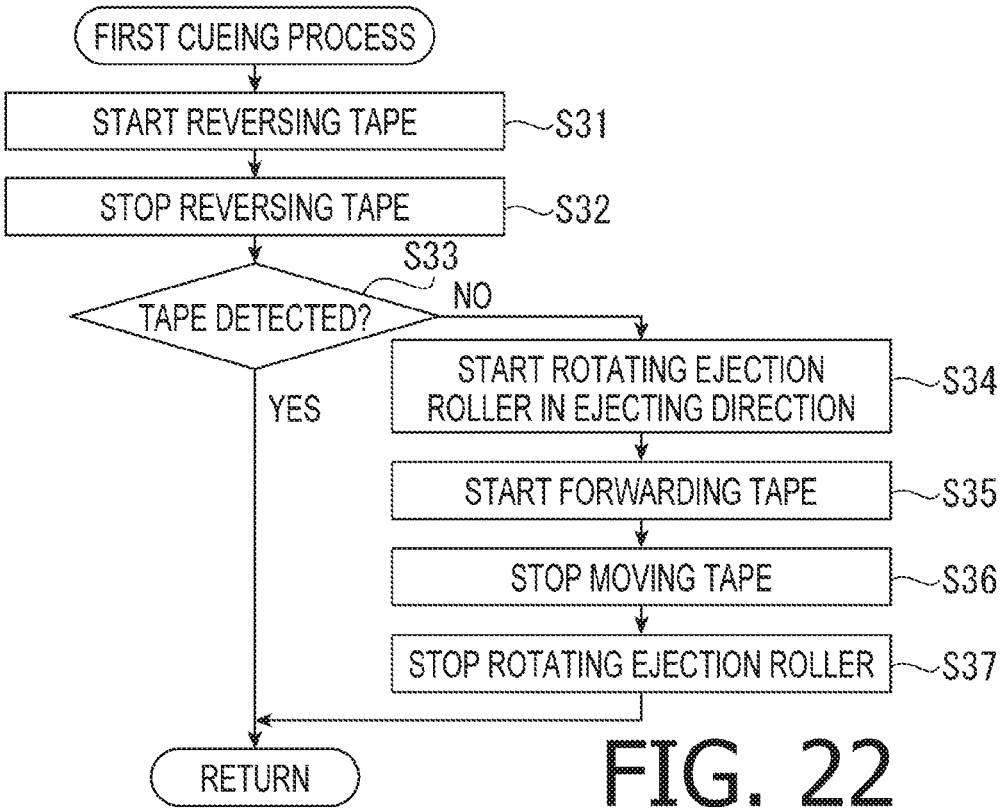

FIG. 22 is a flowchart to illustrate a first cueing process to be executed in the printing apparatus 1 according to the embodiment of the present disclosure.

Figure 23A:
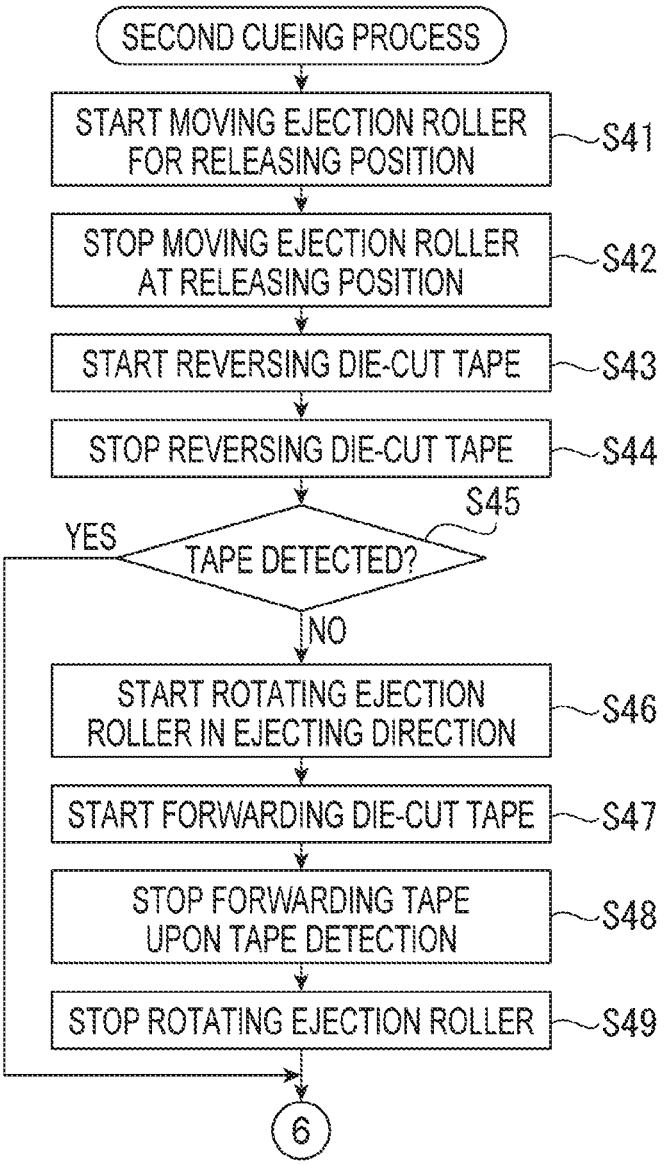
Figure 23B:
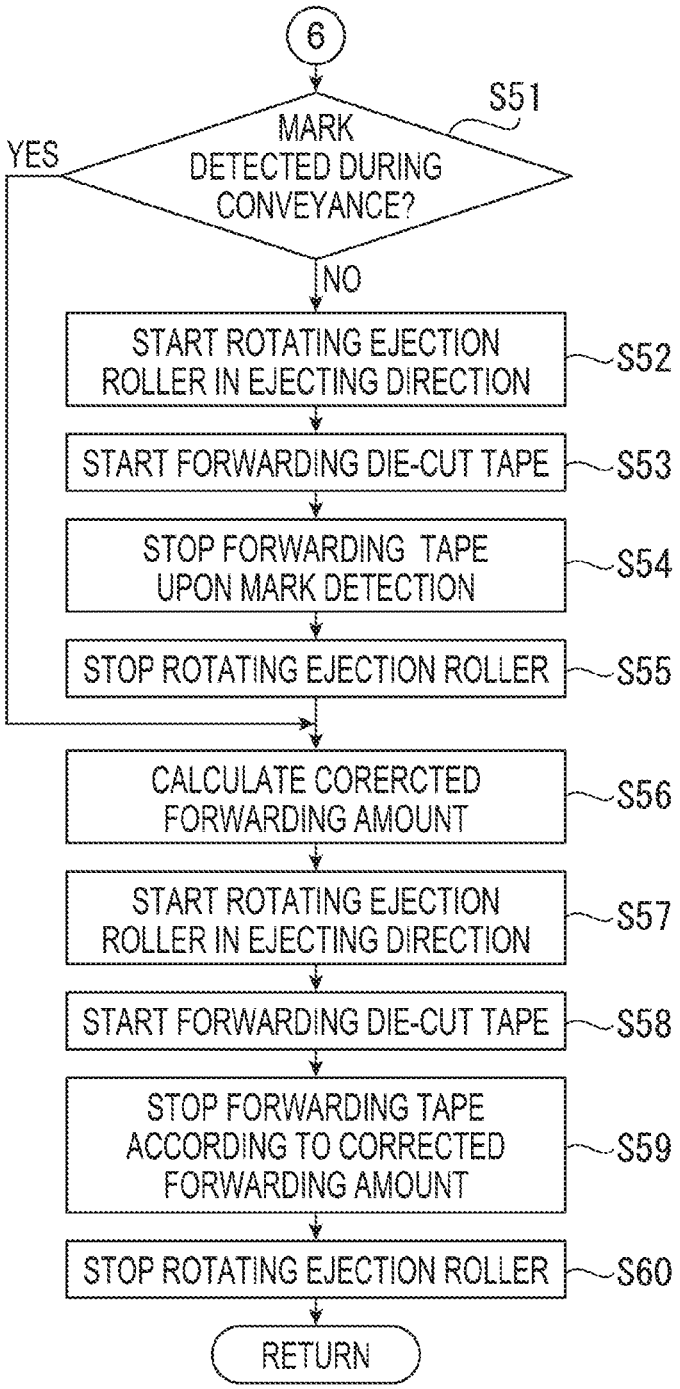

FIGS. 23A-23B are a flowchart to illustrate a second cueing process to be executed in the printing apparatus 1 according to the embodiment of the present disclosure.

FIG. 24 illustrates a rotation amount determining table 30 according to the embodiment of the present disclosure.

DETAILED DESCRIPTION

Hereinafter, with reference to the accompanying drawings, described below will be a printing apparatus 1 according to the embodiment of the present disclosure. It may be noted that structures of the printing apparatus 1 according to the present disclosure may not necessarily be limited to those shown in the accompanying drawings or described in the paragraphs below but may be regarded as merely an example. It may be noted that in the accompanying drawings, teeth in gears are omitted so that the gears may be expressed in simplified forms of discs.

In the following paragraphs, described will be an overall configuration of the printing apparatus 1 according to the embodiment of the present disclosure. In the embodiment described below, directions related the printing apparatus 1 and parts and members included in the printing apparatus 1 will be mentioned on basis of a posture of the printing apparatus 1 with reference to arrows in each drawing. For example, in FIG. 1, sides of the printing apparatus 1 on a viewer's lower-leftward direction, upper-rightward direction, lower-rightward direction, upper-leftward direction, upward direction, and downward direction correspond to a left side, a right side, a front side, a rear side, an upper side, and a lower side of the printing apparatus 1, respectively. A front-to-rear or rear-to-front direction may be expressed as a front-rear direction, an up-to-down or down-to-up direction may be expressed as a vertical direction, and a left-to-right or right-to-left direction may be expressed as a crosswise direction. The printing apparatus 1 is a general cassette-exchangeable printer, in which multiple types of cassettes, such as receptor-typed, thermal-typed, and laminated-typed cassettes, may be usable. FIG. 2 illustrates a receptor-typed cassette 7. In the following description, a strip of printing medium, including, for example, a receptor tape 5, a die-cut tape 9, a thermosensitive tape (not shown), a stencil tape (not shown), a double-face adhesive tape (not shown), a translucent film tape (not shown), will be collectively called as a tape. The printing apparatus 1 is connectable with an external terminal (not shown) through, for example, a network or a cable. The external terminal may include, for example, a personal computer and a smartphone. The printing apparatus 1 may, for example, print an image of a character on the tape based on print data transmitted from the external terminal. The character may include, for example, a letter, a numerical figure, a sign, a symbol, and a graphic.

Figure 1:
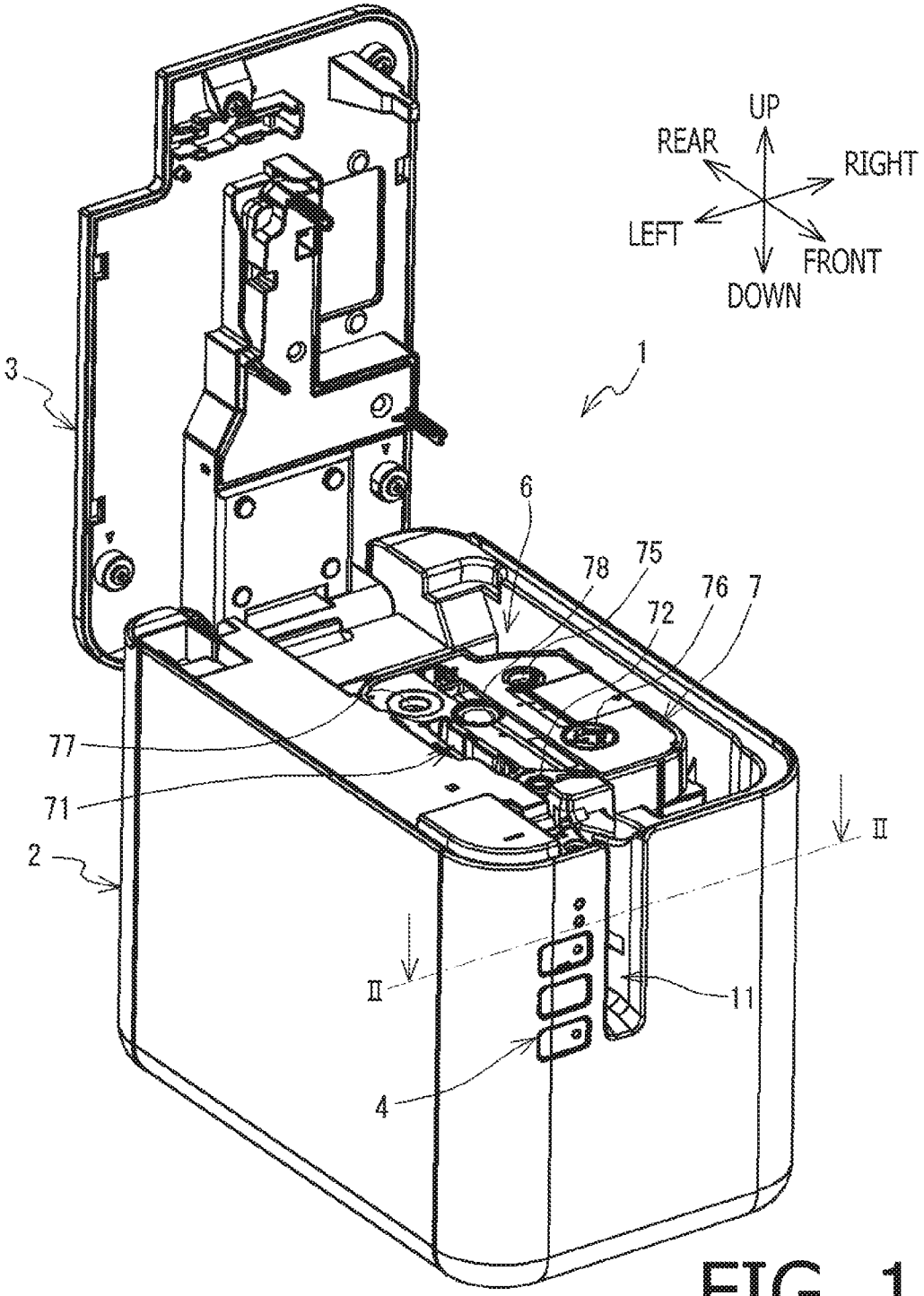
FIG. 1 is a perspective view of a printing apparatus 1 according to an embodiment of the present disclosure.

As shown in FIG. 1, the printing apparatus 1 includes a body 2 and a cover 3. The body 2 may have an approximate shape of a rectangular box. The cover 3 is pivotably supported by an upper-rearward part of the body 2 to open and close a top of the body 2. At a leftward area on a front face of the body 2, arranged is an input interface 4. The input interface 4 includes buttons, through which information may be input in the printing apparatus 1. On the front face of the body 2, at a rightward area with respect to the input interface 4, arranged is an outlet 11, which is an opening elongated in the vertical direction, and through which an interior and an exterior of the body 2 are continuous with each other.

In an upper area in the body 2, formed is an attachment room 6. The attachment room 6 is deepened downward from an upper end of the body 2. The attachment room 6 has a depth along the vertical direction, and a cassette 7 to be used in the printing apparatus 1 may be attached to the attachment room 6. The attachment room 6 includes a passage area 6A (see FIG. 16). The passage area 6A forms a cavity, which is open in the front-rear direction and upward, and through which the tape may be conveyed. The passage area 6A is formed in a leftward and frontward end area in the attachment room 6, on a leftward side with respect to a center C (see FIG. 2) of the attachment room 6. In other words, the passage area 6A forms a leftward and frontward part of the attachment room 6, on the leftward side with respect to the center of the attachment room 6. The center C is a position where a central position in the front-rear direction within a part of the attachment room 6 having a largest dimension in the front-rear direction coincides with a central position in the crosswise direction within a part of the attachment room 6 having a largest dimension in the crosswise direction.

As shown in FIG. 2, in the attachment room 6, arranged are a thermal head 60, a tape-driving shaft 61, a ribbon-reel shaft 62, and a mark-detector sensor 31. The thermal head 60 is arranged on a leftward face of a head holder 69 and includes a plurality of heater elements aligning vertically. The head holder 69 is arranged in a leftward area in the attachment room 6 and has a shape of a plate spreading orthogonally to the crosswise direction. The tape-driving shaft 61 axially extends in the vertical direction at a frontward position with respect to the head holder 69 and is rotatable. The ribbon-reel shaft 62 axially extends in the vertical direction at a rightward position with respect to the head holder 69 and is rotatable. The mark-detector sensor 31 is a transmissive photo-sensor and may detect a mark 99 (see FIG. 3) arranged on the die-cut tape 9, which will be described further below.

At a position leftward with respect to the attachment room 6, arranged is a platen holder 63. The platen holder 63 is swingably supported by a shaft 64 at a rearward end part thereof. The shaft 64 axially extends in the vertical direction. The platen holder 63 rotatably supports a platen roller 65 and a conveyer roller 66 to rotate clockwise and counterclockwise, respectively, in a plane view. The platen roller 65 faces the thermal head 60 from the left. The conveyer roller 66 is arranged at a frontward position with respect to the platen roller 65 and faces the tape-driving shaft 61 from the left. A frontward portion of the platen holder 63 is swingable in the crosswise direction about the shaft 64 so that the platen roller 65 and the conveyer roller 66 may move between positions (see FIG. 2) closer to the thermal head 60 and to the tape-driving shaft 61, respectively, and positions (not shown) farther from the thermal head 60 and from the tape-driving shaft 61, respectively.

The tape-driving shaft 61, the ribbon-reel shaft 62, the platen roller 65, and the conveyer roller 66 are coupled with a conveyer motor 68 (see FIG. 18) through gears, which are not shown. The conveyer motor 68 may be driven to rotate in a forwarding direction and a reversing direction, which are opposite rotational directions.

Inside the body 2, in the proximity of a rearward end of the outlet 11, arranged is an interior unit 10. The interior unit 10 includes a cutter unit 100 and an ejection unit 200. The cutter unit 100 may cut the tape, and actions to cut the tape by the cutter unit 100 include a partial-cutting action and a full-cutting action. In particular, an action to cut the tape in a widthwise direction with a part of a thickness of the tape being left uncut will be called as a partial-cutting action, and an action to cut the tape throughout the width and the thickness thereof completely into two separate pieces may be called as a full-cutting action. The ejection unit 200 may hold the tape to be cut by the cutter unit 100 and eject the tape cut by the cutter unit 100 outward through the outlet 11. The cutter unit 100 and the ejection unit 200 will be described further below.

With reference to FIG. 2, described below will be the cassette 7. The cassette 7 includes a case 70 and an outlet 73 (see FIG. 16). The case 70 has a form of a box and includes a tape-driving roller 72 and supporting holes 75-78. The tape-driving roller 72 is in a cylindrical shape axially extending in the vertical direction at a left-front corner area and is rotatably supported by the case 70. A leftward end portion of the tape-driving roller 72 is exposed outside the case 70.

The supporting hole 75 is formed vertically through the case 70 to support a first tape spool 41 rotatably. The first tape spool 41 axially extends in the vertical direction, and a first tape may be rolled there-around. The supporting hole 77 is formed vertically through the case 70 to support a ribbon spool 43 rotatably. The ribbon spool 43 axially extends in the vertical direction, and an ink ribbon 8 in an unused condition may be rolled there-around. The supporting hole 78 is formed vertically through the case 70 to support a ribbon-reel spool 45 rotatably. The ribbon-reel spool 45 has a cylindrical shape extending axially in the vertical direction, and the ink ribbon 8 in a used condition may be rolled there-around. The supporting hole 76 is formed vertically through the case 70 to support a second tape spool (not shown) rotatably. The second tape spool axially extends in the vertical direction, and a second tape may be rolled there-around.

The outlet 73 (see FIG. 16) forms a part of a left-front end area in the case 70 (see FIG. 2). The outlet 73 is open in the front-rear direction and is arranged at a position rearward with respect to the passage area 6A. The tape traveling through the outlet 73 may exit the case 70 and enter the passage area 6A. In other words, the tape may be ejected outside the case 70 through the outlet 73 toward the passage area 6A.

The case 70 has a head opening 71 and paired holes 79. The head opening 71 is formed vertically through the case 70 at a leftward area in the case 70. The tape may be exposed at a left-front area with respect to the head opening 71. The paired holes 79 are formed vertically through the case 70 to face each other in the front-rear direction to interpose the tape drawn from the first tape spool 41 there-between.

The cassette 7 is adapted to store tapes in different types, which may or may not include the ink ribbon 8, so that the cassette 7 may serve as, for example, the thermal-typed cassette, the receptor-typed cassette, the laminated-typed cassette, or a tube-typed cassette, occasionally.

When the cassette 7 is the receptor-typed cassette, the supporting hole 75 may support the first tape spool 41, around which the receptor tape 5 or the die-cut tape 9 being the first tape is rolled. The receptor-typed cassette 7 does not use the second tape; therefore, the supporting hole 76 supports no second tape spool. Meanwhile, the supporting hole 77 supports the ribbon spool 43.

When the cassette 7 is a thermal-typed cassette, the supporting hole 75 may support the first tale spool 41, around which either a thermosensitive tape or a stencil tape being the first tape is rolled. The supporting hole 76 supports no tape spool for the second tape. The supporting hole 77 supports no ribbon spool 430.

When the cassette 7 is the laminated-typed cassette, the supporting hole 75 may support the first tape spool 41, around which a transparent film tape being the first tape is rolled. The supporting hole 76 may support the second tape spool, around which a double-face adhesive tape being the second tape is rolled. The supporting hole 77 may support the ribbon spool 43.

Figure 3A:
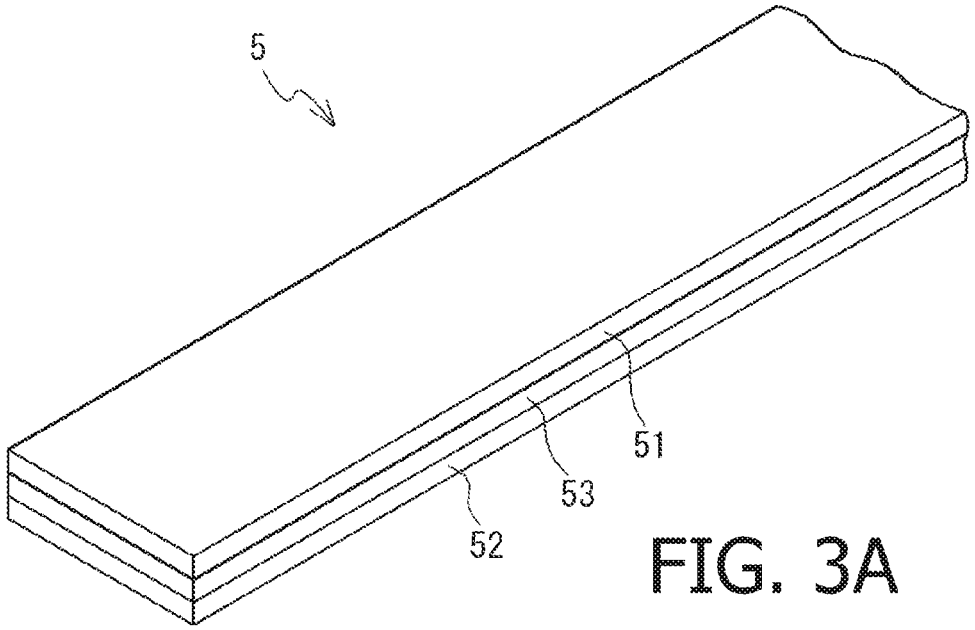
FIGS. 3A and 3B are perspective views of a receptor tape 5 and a die-cut tape 9, respectively, according to the embodiment of the present disclosure.
Figure 3B:
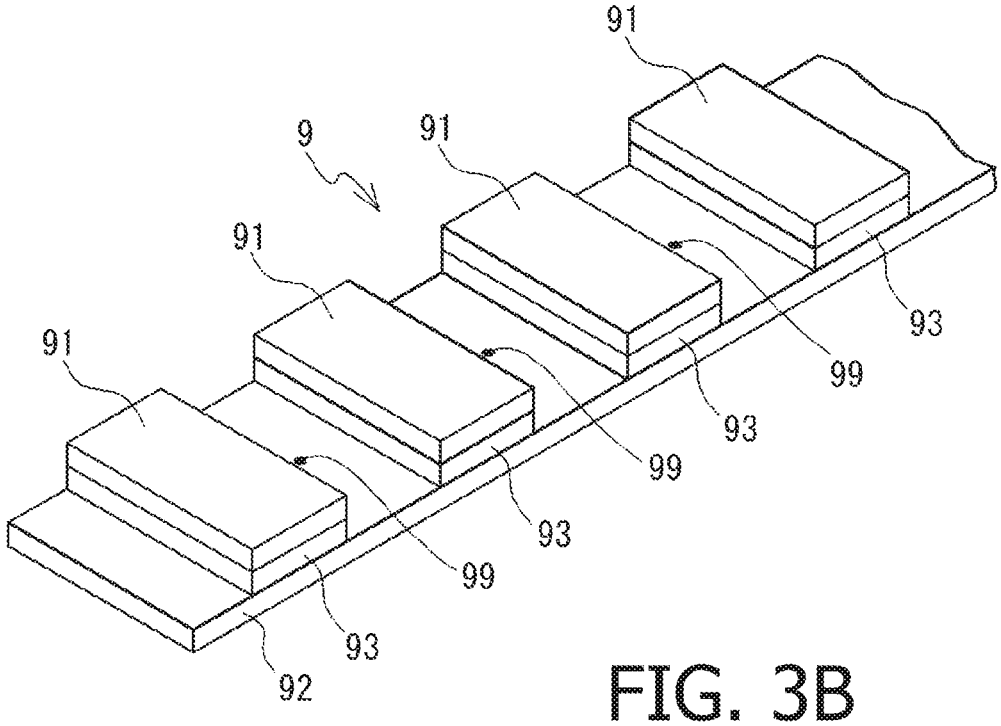

Referring to FIGS. 3A and 3B, described below will be the receptor tape 5, the die-cut tape 9, the thermosensitive tape (not shown), the transparent film tape (not shown), and the double-face adhesive tape (not shown) being the examples of the tape. As shown in FIG. 3A, the receptor tape 5 includes a base strip 51 and a release paper 52. The base strip 51 includes an adhesive layer 53, which is a layer of an adhesive agent, as well as an adhesive layer 93 (see FIG. 3B) described below. A surface of the base strip 51 opposite to the adhesive layer 53 is a printable surface, on which characters may be printed. The release paper 52 is releasably adhered to the base strip 51 through the adhesive layer 53.

As shown in FIG. 3B, the die-cut tape 9 includes a plurality of base pieces 91 and a release paper 92. Each of the base pieces 91 includes the adhesive layer 93. The release paper 92 is an elongated strip of paper. On a surface of the release paper 92, the base pieces 91 are releasably adhered to the adhesive layer 93 at equal intervals along the longitudinal direction of the release paper 92. A surface of each base piece 91 opposite to the adhesive layer 93 is a printable surface, on which characters may be printed. On the surface of the release paper 90, where no base piece 91 is arranged, formed are marks 99. The marks 99 are holes formed through the release paper 90 aligning along the longitudinal direction of the release paper 90 at equal intervals. The receptor tape 5 and the die-cut tape 9 are printable tapes with the base strip 51 and the base pieces 91, respectively, having the printable surfaces, on which characters may be printed in the ink thermally transferred from the ink ribbon 8 by the thermal head 60.

The thermosensitive tape (not shown) is a printable tape, on which characters may be printed by the heat applied by the thermal head 60. The stencil tape (not shown) is a tape, in which holes having outlines representing forms of characters may be formed by the heat applied by the thermal head 60. In this regard, the term "print" in the present embodiment includes forming a hole that has an outline representing a form of a character in the tape.

The transparent film tape is a printable tape, on which characters may be printed in the ink thermally transferred from the ink ribbon 8 by the thermal head 60. To the printable surface of the transparent film tape, with the characters printed thereon, a double-face adhesive tape may be adhered. In the following paragraphs, the tape, in which the transparent film tape with the characters printed thereon and with the double-face adhesive tape adhered thereto, may be called as a laminated tape.

The die-cut tape 9 may be more flexible than the receptor tape 5 and the thermosensitive tape. Meanwhile, the receptor tape 5 and the thermosensitive tape may be more flexible than the laminated tape. The laminated tape may be more flexible than the stencil tape. The flexibility of the tape may depend on several factors including thickness and Young's modulus of the tape. For example, the thicker the tape is, the less flexible the tape may be; and the greater the Young's modulus is, the less flexible the tape may be. Meanwhile, the receptor tape 5, the thermosensitive tape, the stencil tape, and the laminated tape may be more damageable than the die-cut tape 9. The damageability of the tape may depend on several factors including a material of a surface or a coating material of the tape and a surficial form (e.g., smoothness, unevenness, etc.) of the tape. For example, the harder the surface of the tape is, the less damageable the tape may be. Meanwhile, the types of the tapes to be used in the printing apparatus 1 may not necessarily be limited to those mentioned above but may include, for example, a tube tape. Moreover, the flexibilities and the damageability of the tapes mentioned above may be regarded merely as examples.

With reference to FIGS. 1-2, a procedure to print a character on the tape in the receptor-typed cassette 7 in the printing apparatus 1 will be described. When the cover 3 is open, the platen roller 65 and the conveyer roller 66 are located at positions separated leftward from the thermal head 60 and the tape-driving shaft 61, respectively. With the platen roller 65 and the conveyer roller 66 separated from the thermal head 60 and the tape-driving shaft 61, a user may attach the cassette 7 to the attachment room 6. When the cassette 7 is attached to the attachment room 6, the ribbon-reel shaft 62 is inserted in the ribbon-reel spool 45, and the tape-driving shaft 61 is inserted in the tape-driving roller 72. Moreover, a light emitter (not shown) and a light receiver (not shown) in the mark-detector sensor 31 enter the case 70 through the holes 79. The light emitter and the light receiver in the mark-detector sensor 31 face each other in the case 70 across the tape drawn from the first tape spool 41. The receptor tape 5 and the ink ribbon 8 are arranged in the printing apparatus 1 in postures, in which widths of the receptor tape 5 and the ink ribbon 8 align with the vertical direction.

When the cover 3 is closed, the platen roller 65 and the conveyer roller 66 are moved rightward to positions closer to the thermal head 60 and the tape-driving shaft 61, respectively, so that the platen roller 65 may press the receptor tape 5, with the ink ribbon 8 layered on the printable surface of the base strip 51, against the thermal head 60. The conveyer roller 66 may press the receptor tape 5 against the tape-driving roller 72. This condition of the printing apparatus 1, in which the cassette 7 is attached to the attachment room 6, and the cover 3 is closed, may be called as a print-ready condition.

In the following paragraphs, a position in a conveying direction where the platen roller 65 and the thermal head 60 nip the tape there-between may be called as a printing position P1, and a position in the conveying direction where the conveyer roller 66 and the tape-driving roller 72 nip the tape there-between may be called as a first nipping position P2. Meanwhile, a load by the platen roller 65 to nip the tape with the thermal head 60 may be called as a nipping load at the printing position P1, and a load by the conveyer roller 66 to nip the tape with the tape-driving roller 72 may be called as a nipping load at the first nipping position P2. The first nipping position P2 is located downstream from the printing position P1 in the conveying direction. The nipping load at the first nipping position P2 is smaller than the nipping load at the printing position P1.

The printing apparatus 1 may convey the tape by rotating the tape-driving shaft 61, the platen roller 65, and the conveyer roller 66. The term "convey" or "conveyance" includes forwarding and reversing. Forwarding the tape may mean conveying the tape downstream in the conveying direction by pulling the tape out of the first tape spool 41, and reversing the tape may mean conveying the tape upstream in a direction reversed from the conveying direction. In a range between the outlet 11 and the outlet 73, the conveying direction coincides with the front-rear direction, a downstream side in the conveying direction coincides with the frontward side, and an upstream side in the conveying direction coincides with the rearward side.

In order to forward the tape, the printing apparatus 1 may drive the conveyer motor 68 (see FIG. 18) to rotate in a direction corresponding to forwarding so that the tape-driving shaft 61 may rotate, in a plan view, counterclockwise and that the platen roller 65 and the conveyer roller 66 may rotate, in the plan view, clockwise. Along with the counterclockwise rotation of the tape-driving shaft 61, the tape-driving shaft 72 may rotate, in the plan view, counterclockwise. Thereby, the tape may be nipped between the conveyer roller 66 and the tape-driving roller 72 and forwarded downstream in the conveying direction. Meanwhile, the receptor tape 5 may be nipped between the platen roller 65 and the thermal head 60 and forwarded downstream.

In order to reverse the tape, the printing apparatus 1 may drive the conveyer motor 68 to rotate in a direction corresponding to reversing so that the tape-driving shaft 61 may rotate, in the plan view, clockwise and that the platen roller 65 and the conveyer roller 66 may rotate, in the plan view, counterclockwise. Along with the clockwise rotation of the tape-driving shaft 61, the tape-driving shaft 72 may rotate, in the plan view, clockwise. Thereby, the tape may be nipped between the conveyer roller 66 and the tape-driving roller 72 and reversed upstream in the conveying direction. Meanwhile, the receptor tape 5 may be nipped between the platen roller 65 and the thermal head 60 and reversed upstream. In the following paragraphs, the action to forward the tape may be called as a forwarding action, and an action to reverse the tape may be called as a reversing action.

In the following description, a path, in which the tape being conveyed travels between the outlet 73 of the cassette 7 and the outlet 11 of the body 2 in the printing apparatus 1 may be called as a conveyer path 12 (see FIG. 16). The conveyer path 12 is a path, in which the tape being conveyed frontward from the outlet 73 travels, and extends in the front-rear direction. In FIG. 16, in order to improve visibility, the conveyer path 12 is drawn at a position displaced from the tape in the crosswise direction.

The printing apparatus 1 may cue the tape to be located at a predetermined position before a printing action. In order to cue the tape, the printing apparatus 1 may control the conveyer motor 68 and convey the tape at least by the reversing action, and additionally by the forwarding action occasionally.

After cueing, the printing apparatus 1 may conduct the printing action, in which the printing apparatus 1 may forward the tape and print characters on the tape. Specifically, the printing apparatus 1 may activate the thermal head 60 to apply the heat to the ink ribbon 8. Thereby, the ink on the ink ribbon 8 may be thermally transferred onto the printable surface of the base strip 51 in the receptor tape 5, and characters may be printed on the tape at the printing position P1. The printing apparatus 1 may drive the conveyer motor 68 in the direction corresponding to forwarding so that the ribbon-reel shaft 62, the tape-driving shaft 61, the platen roller 65, and the conveyer roller 66 may rotate. Along with the rotation of the ribbon-reel shaft 62, the ribbon-reel spool 45 may rotate, and the ink ribbon 8 may be reeled around the ribbon-reel spool 45. Meanwhile, along with the rotation of the tape-driving shaft 61, the tape-driving roller 72 may rotate, in the plan view, counterclockwise. Moreover, along with the rotation of the tape-driving shaft 72 and the tape-driving roller 61, the receptor tape 5 nipped by the conveyer roller 66 and the tape-driving roller 72 at the first nipping position P2 may be forwarded. Meanwhile, along with the rotation of the platen roller 65, the receptor tape 5 nipped by the platen roller 65 and the thermal head 60 may be forwarded.

The receptor tape 5 with the characters printed thereon may be ejected outside the cassette 7 through the outlet 73 and travel through the passage area 6A. The receptor tape 5 traveled through the passage area 6A may reach the cutter unit 100, which is located downstream from the passage area 6A in the conveying direction. The receptor tape 5 may be cut by the cutter unit 100, and a part of the receptor tape 5 cut by the cutter unit 100 may be ejected outside the printing apparatus 1 through the outlet 11 by the ejection unit 200.

With reference to FIGS. 4-8, described below will be a detailed configuration of the cutter unit 100. In FIGS. 5 and 6, and in FIGS. 9 and 10, illustration of a second frame 109, a motor gear 105B, and coupling gears 125, 126 in the cutter unit 100 are omitted. The cutter unit 100 is arranged inside the body 2 at a rearward position with respect to the outlet 11 and a frontward position with respect to the passage area 6A.

Figure 4:
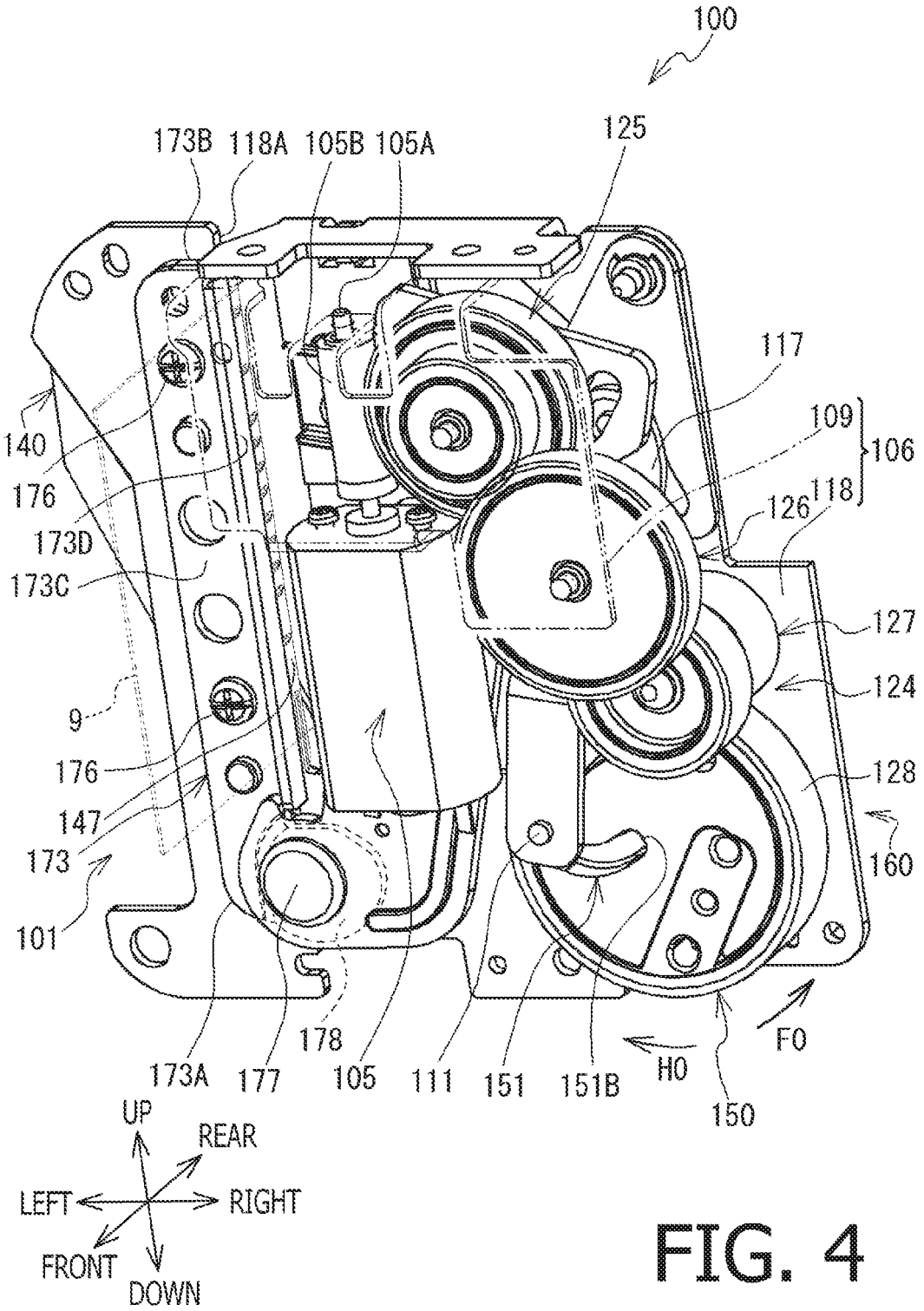
FIG. 4 is a perspective view of a cutter unit 100 in an initial condition viewed from a rightward frontal and upper position according to the embodiment of the present disclosure.

As shown in FIG. 4, the cutter unit 100 includes a fixed frame 106, which is fixed to an internal structure (not shown) in the body 2 (see also FIG. 1). The fixed frame 106 includes a first frame 118 and a second frame 109. The second frame 109 is in an approximately rectangular shape, in a rear view, as drawn in dash-and-dots lines. The first frame 118 is arranged at a rearward position with respect to the second frame 109 and includes a first passage 118A. The first passage 118A is formed through the first frame 118 in the front-rear direction at a rearward coincident position with a second passage 201, which will be described further below. On a leftward edge of the first passage 118A, arranged is a guiding member 147. The guiding member 147 has a plurality of ribs, which project rightward, aligning in the vertical direction. The guiding member 147 may guide the tape being forwarded at the second passage 201.

To the first frame 118, fixed is a placement base 173, which has an approximate shape of a plate. A lower end 173A of the placement base 173 is located to be lower than the first passage 118A. The lower end 173A of the placement base 173 includes a protrusion 178, which protrudes frontward. The protrusion 178 is formed to have a fixing hole (now shown), which has a circular shape in a front view. To the fixing hole, fixed is a shaft 177, which axially extends in the front-rear direction. The placement base 173 includes a linear portion 173C and a placement board 173D. The linear portion 173C extends between the lower end 173A and an upper end 173B of the placement base 173. The linear portion 173C is fixed to the first frame 118 by two (2) screws 176 at a leftward position with respect to the first passage 118A. The placement board 173D has a rectangular shape extending in the vertical direction in a view from the right along the crosswise direction and protrudes frontward from a rightward end of the linear portion 173C. On the placement board 173D, arranged is a portion of the tape that is located upstream in the conveying direction, i.e., rearward, with respect to the guiding member 147.

At a rightward position with respect to the first passage 118A, fixed to a lower end of the second frame 109 is a cutter motor 105. An output shaft 105A of the cutter motor 105 extends upward from the cutter motor 105. To the output shaft 105A, fixed is a motor gear 105B. The motor gear 105B may be, for example, a worm gear.

At a lower-rightward and rearward position with respect to the cutter motor 105, arranged is a rotating body 150. The rotating body 150 has a circular shape in a front view and is located at a rightward position with respect to the shaft 177. The rotating body 150 is rotatably supported by a shaft 159 (see FIG. 8). The shaft 159 penetrates through the first frame 118 in the front-rear direction and is fixed to the first frame 118.

At a rightward position with respect to the output shaft 105A, arranged is a gear train 124. The gear train 124 includes coupling gears 125, 126, 127 and a specific gear 128. The coupling gears 125-127 and the specific gear 128 align vertically from up to down in this given order and are rotatable about respective axes that extend in the front-rear direction. The coupling gears 125-127 are two-step gears. The coupling gears 125, 126 are rotatably supported by the second frame 109. The coupling gear 125 meshes with the motor gear 105B. The coupling gear 127 is rotatably supported by the first frame 118. The specific gear 128 is at a downstream end of a driving-force transmitting flow within the gear train 124 and is formed integrally with an outer peripheral surface of the rotating body 150. The coupling gears 125-127 and the specific gear 128 mesh with one another; therefore, a driving force from the cutter motor 105 is transmitted through the motor gear 105B and the gear train 124 to the rotating body 150.

As shown in FIGS. 5 and 6, in the rotating body 150, formed are groove cams 151, 152. The groove cams 151, 152 are open frontward and are continuous with each other. The groove cam 151 has a starting edge 151A on one end and a terminal edge 151B on the other end. The groove cam 151 extends from the starting edge 151A to the terminal edge 151B in a direction to be closer to the shaft 159. The groove cam 152 extends in an arc centered about the shaft 159 in a clockwise direction in a front view. In the following paragraphs, the groove cams 151, 152 may be collectively called as a groove 153.

At an upper-leftward position with respect to the rotating body 150, arranged is a shaft 119. The shaft 119 protrudes frontward from the first frame 118 and swingably supports a first link member 110. The first link member 110 is arranged to face the first frame 118 at a position spaced apart from the first frame 118 in the front-rear direction and extends in the vertical direction. A part of the first link member 110 which is lower than the shaft 119 extends frontward and is bent to extend downward. Another part of the first link member 110 which is higher than the shaft 119 extends in the vertical direction. A lower portion 116 of the first link member 110 is arranged frontward with respect to the rotating body 150. On the lower end portion 116, arranged is a pin 111, which protrudes rearward from the lower end portion 116 and engages with the groove cam 153. As the rotating body 150 rotates, the groove cam 151 may move with the pin 111 sliding therein so that the first link member 110 may swing about the shaft 119 leftward and rightward.

In an upper end portion 117 of the first link member 110, arranged are a pin 112 and a recess 139. The pin 112 protrudes rearward from the upper end portion 117 and is inserted in a through hole 197 (see FIG. 8), which is formed through the first frame 118 in the front-rear direction. The recess 139 is formed to recess in a clockwise direction in a front view.

At a position between the first link member 110 and the first frame 118, arranged is a second link member 120. The second link member 120 is swingably supported by a supporting shaft 129. The supporting shaft 129 protrudes frontward from the first frame 118 at a rightward position with respect to an upper end 173B. The second link member 120 is a plate having an approximate shape of a fan that spreads from the supporting shaft 129 and is arranged to face and contact the first frame 118 from a frontward position. An end portion 121 of the second link member 120 that is farther from the supporting shaft 129 faces the upper end portion 117 from a rearward position.

As shown in FIG. 7, in the end portion 121, formed is a groove cam 122. The groove cam 122 engages with the pin 112 and includes cams 122A, 122B. The cams 122A, 122B are grooves formed continuously with each other. The cam 122A is closer to the supporting shaft 129, and the cam 122B is farther from the supporting shaft 129. The cam 122A extends in a direction to be apart from the supporting shaft 129, and the cam 122B extends from the cam 122A in a direction to be further apart from the supporting shaft 129. The directions in which the cams 122A, 122B extend intersect with each other. As the first link member 110 swings, and the pin 112 slides with respect to the groove cam 122, the second link member 120 may swing about the supporting shaft 129. In the end portion 121, arranged is a pin 113. The pin 113 as shown in FIG. 7 protrudes frontward from the end portion 121 to be located inside the recess 139.

As shown in FIGS. 5 and 6, at a frontward position with respect to the second link member 120, arranged is a movable holder 130. The movable holder 130 is swingably supported by a shaft 177. A lower end portion 137 of the movable holder 130 is swingably coupled with the shaft 177 at a frontward position with respect to the lower end 173A of the placement base 173.

The movable holder 130 includes an attachment portion 134, a partial-cutting blade 103, and a protrusive portion 131. The attachment portion 134 extends between a lower end portion 137 and an upper end portion 138 and faces the cutter motor 105 (see FIG. 4) from a rearward position. The partial-cutting blade 103 is a flat piece of blade, of which thickness aligns in the front-rear direction. In other words, the partial-cutting blade 103 spreads in directions orthogonal to the front-rear direction. The partial-cutting blade 103 is fixedly attached to a rearward surface of the attachment portion 134. A leftward end of the partial-cutting blade 103 is sharpened to form an edge 103A. The edge 103A protrudes slightly leftward from the linear portion 173C along a swingable direction of the movable holder 130. The edge 103A may face with the placement board 173D in the placement base 173 along the swingable direction of the movable holder 130. The protrusive portion 131 protrudes leftward from the upper end portion 138 along the swingable direction of the movable holder 130 and may face the placement board 173D along the swingable direction of the movable holder 130. A leftward end of the protrusive portion 131 is located slightly leftward with respect to the edge 103A.

As shown in FIG. 7, in the upper end portion 138, formed is a groove cam 133. The groove cam 133 engages with the pin 113 in the second link member 120 and includes cams 133A, 133B. The cams 133A, 133B are grooves formed continuously with each other. The cam 133A extends in a direction to be away from the shaft 177 (see FIG. 6), and the cam 133B extends from the cam 133A in a direction to be further away from the shaft 177. The cams 133A, 133B extend in different directions.

As the second link member 120 swings, the pin 113 may slide with respect to the groove cam 133, and the movable holder 130 may swing about the shaft 177 between a partial-cutting position (see FIG. 9) and a retracted position (see FIG. 5). The partial-cutting position is one of positions for the movable holder 130, in which the leftward end of the protrusive portion 131 contacts the placement board 173D. The retracted position is another one of the positions for the movable holder 130, in which the movable holder 130 is retracted rightward with respect to the partial-cutting position. When the movable holder 130 is at the retracted position, the edge 103A is separated rightward from the tape placed on the placement board 173D. The edge 103A is located rightward with respect to the leftward end of the protrusive portion 131. Therefore, when the movable holder 130 is at the partial-cutting position, clearance is reserved between the edge 103A and the placement board 173D. An amount of the clearance in the swingable direction for the movable holder 130 is smaller than a thickness of the tape.

As shown in FIG. 8, on the rear side of the first frame 118, attached are a stationary blade 179 and a full-cutting blade 140. The stationary blade 179 is fixed to the first frame 118 at a rightward position with respect to the first passage 118A. The stationary blade 179 has an approximate shape of a rectangular plate elongated in the vertical direction, in a rear view. To a lower end 179A of the stationary blade 179, fixed is a shaft 199. The shaft 199 axially extends in the front-rear direction and protrudes rearward from the first frame 118. The stationary blade 179 includes an edge 179C, which is on a leftward end of the stationary blade 179 and sharpened along the vertical direction. The tape may be arranged between the lower end 179A and an upper end 179B of the stationary blade 179 in the vertical direction to face the edge 179C along the crosswise direction. The edge 179C is located rightward with respect to the first passage 118A. In other words, the edge 179C is located rightward with respect to the conveyer path 12.

The full-cutting blade 140 has an approximate shape of an L in a front view and is swingably supported by the shaft 199 at a position between the first frame 118 and the stationary blade 179 in the front-rear direction. The full-cutting blade 140 includes arms 141, 142. The arm 141 extends upward from the shaft 199, and the arm 142 extends rightward from the shaft 199. A leading end of the arm 141 in a counterclockwise direction for the full-cutting blade 140 to swing about the shaft 199, in a rear view, is sharpened along the extending direction of the arm 141 to form an edge 141A. The edge 141A may face the edge 179C of the stationary blade 179 along a swingable direction of the full-cutting blade 140.

According to the present embodiment, a maximum length of the arm 141 in a circumferential direction for the swing motion of the full-cutting blade 140 to swing about the shaft 199 is smaller than a maximum length of the movable holder 130 in a circumferential direction for the swing motion of the movable holder 130 to swing about the shaft 177. In the present embodiment, the maximum length of the movable holder 130 in the circumferential direction for the swing motion of the movable holder 130 to swing about the shaft 177 is a maximum length of the attachment portion 134.

In a rightward portion of the arm 142, formed is a groove cam 144. The groove cam 144 is formed through the arm 142 in the front-rear direction and is engaged with a pin 114. The pin 114 protrudes rearward from the rotating body 150 and is inserted through an insertion hole 115 in the first frame 118. The insertion hole 115 is formed through the first frame 118 in the front-rear direction and extends in an arc, which is centered at the shaft 159.

The groove cam 144 includes an arc cam 145 and a linear cam 146. The arc cam 145 and the linear cam 146 are formed continuously with each other. The arc cam 145 has a starting edge 145A on one end and a terminal edge 145B on other end. The arc cam 145 extends in an arc from the starting edge 145A to the terminal edge 145B centered about the shaft 159 in a counterclockwise direction in a rear view. The linear cam 146 extends linearly from the starting edge 145A of the arc cam 145 toward the shaft 199.

As the rotating body 150 rotates, the pin 114 may slide in the linear cam 146 to move with respect to the linear cam 146, and the full-cutting blade 140 may swing about the shaft 199 between a full-cutting position (see FIG. 12) and a separated position (see FIG. 8). The full-cutting position is one of positions for the full-cutting blade 140, in which the edge 141A is located rightward with respect to the edge 179C of the stationary blade 179. The separated position is another one of the positions for the full-cutting blade 140, in which the edge 141A of the full-cutting blade 140 is separated leftward from the tape placed on the edge 179C. The swingable direction of the full-cutting blade 140 is parallel with the swingable direction of the movable holder 130.

In the present embodiment, an action to cut the tape partially may be called as a partial-cutting action. With reference to FIGS. 6 and 9-11, described in the following paragraphs will be the partial-cutting action by the cutter unit 100. Before starting the partial-cutting action, the tape may be conveyed by the rollers in the printing apparatus 1 to a position beyond the first passage 118A and placed on the placement board 173D. Meanwhile, before starting the partial-cutting action, the cutting unit 100 is in an initial condition (see FIGS. 6 and 8). When the cutter unit 100 is in the initial condition, the pin 111 contacts the starting edge 151A; the pin 112 contacts an upper end of the cam 122A; the pin 113 contacts a lower edge of the groove 133A; the movable holder 130 is located at the retracted position; the pin 114 contacts the starting edge 145A; and the full-cutting blade 140 is located at the separated position.

As the cutter motor 105 (see FIG. 4) starts driving, the motor gear 105B along with the output shaft 105A rotate. The driving force from the cutter motor 105 is transmitted through the gear train 124 to the rotating body 150, and the rotating body 150 rotates in a clockwise direction in a front view, as indicated by an arrow H0. The groove cam 151 in the rotating body 150 rotates, pressing the pin 111 rightward (see FIGS. 6 and 10). Thereby, the first link member 110 may swing in a counterclockwise direction in the front view, as indicated by an arrow H1. As the first link member 110 swings, the pin 112 presses the cam 112A in the groove cam 112 leftward and swing. Thereby, the second link member 120 slidably moves with respect to the first frame 118 and swings in the clockwise direction in a front view, as indicated by an arrow H2. Meanwhile, the pin 112 swings relatively to the second link member 120 upward with respect to the recess 139. Along with the swing motion of the second link member 120, the pin 113 presses the groove 133A in the groove cam 133 leftward. Thereby, the movable holder 130 swings from the retracted position toward the partial-cutting position, as indicated by an arrow H3. Meanwhile, the pin 113 slidably moves from one side, which is an end in a direction indicated by an arrow V1 shown in FIGS. 7 and 11, toward the other side, which is another end in a direction indicated by an arrow V2 shown in FIGS. 7 and 11, in the extending direction of the groove cam 133.

While the movable holder 130 swings toward the partial-cutting position, the pin 114 (see FIG. 8) slidably moves from the starting edge 145A toward the terminal edge 145B of the arc cam 145 without pressing the full-cutting blade 140. Therefore, the full-cutting blade 140 may be maintained stopped at the separated position.

As shown in FIGS. 9-11, as the rotating body 150 rotates, the pin 111 slidably moves toward the terminal edge 151B. The pin 112 slidably moves relatively to the cam 122 to exit the cam 122A and enter the cam 122B. Meanwhile, the pin 113 slidably moves relatively to the groove cam 133 to exit the groove 133A and enter the groove 133B. As the movable holder 130 continues swinging, the edge 103A of the partial-cutting blade 103 starts gradually cutting the tape from the lower side to the upper side.

As the edge 103A starts cutting the tape, the pin 112 swings relatively to the cam 122B and moves in a direction to be away from the supporting shaft 129. After the tape is cut to the upper end thereof, the protrusive portion 131 contacts the placement board 173D, and the movable holder 130 reaches the partial-cutting position. In this condition, a part of the thickness of the tape that is accommodated in the clearance formed between the edge 103A and the placement base 173 is left uncut. Thus, the partial-cutting blade 103 may cut the tape partially throughout the width of the tape by the edge 103A. The cutter motor 105 stops driving. In the following paragraphs, a position in the conveying direction, where the partial-cutting blade 103 may cut the tape in the crosswise direction, may be called as a second cutter position P4 (see FIG. 2). The second cutter position P4 is located downstream from a first cutter position P3, which will be described further below, in the conveying direction.

After cutting the tape partially, the cutter motor 105 drives in a driving direction opposite to the driving direction, in which the cutter motor 105 drives in the earlier stage of the partial-cutting action until the tape is cut by the edge 103A. The rotating body 150, the first link member 110, the second link member 120, and the movable holder 130 move in respective directions opposite to the directions moved in the earlier stage of the partial-cutting action. The pin 113 returns to the inner side of the recess 139, and the cutter unit 100 returns to the initial condition. The cutter motor 105 stops driving, and the partial-cutting action is completed.

On the other hand, in the present embodiment, an action to cut the tape fully may be called as a full-cutting action. With reference to FIGS. 6, 8, and 12, described in the following paragraphs will be the full-cutting action by the cutter unit 100. Before starting the full-cutting action, the cutter unit 100 is in the initial condition.

The cutter motor 105 drives to rotate in the direction opposite to the direction of the cutter motor 105 in the earlier stage of the partial-cutting action. Therefore, the rotating body 150 rotates in a counterclockwise direction, as indicated by an arrow F0, in a front view. Meanwhile, the groove cam 152 (see FIG. 6) in the groove 153 slidably moves with respect to the pin 111; therefore, the groove 153 may not press the pin 111. Accordingly, the movable holder 130 may be maintained stopped at the retracted position.

As the rotating body 150 rotates, the pin 114 slidably moves relatively to the linear cam 146, pressing the linear cam 146 downward. Thereby, the full-cutting blade 140 starts swinging toward the full-cutting position in a direction indicated by an arrow F1. As the pin 114 slidably moves relatively to the linear cam 146, the full-cutting blade 140 nips the tape at a position between the edge 141A thereof and the edge 179C of the stationary blade 179 gradually from the lower side to the upper side so that the tape may be cut into two (2) separate pieces. After the edge 179C cuts through the tape vertically, the full-cutting blade 140 reaches the full-cutting position. Thus, the full-cutting blade 140 may fully cut the tape through the width and the thickness with the edges 141A, 179C. The cutter motor 105 stops driving. In the following paragraphs, a position in the conveying direction, where the full-cutting blade 140 may fully cut the tape, may be called as a first cutter position P3. The first cutter position P3 is located downstream from the first nipping position P2 in the conveying direction.

After fully cutting the tape, the cutter motor 105 drives in a direction opposite to the driving direction, in which the cutter motor 105 drives in the earlier stage of the full-cutting action until the tape is cut by the edges 141A, 179C. The rotating body 150 and the full-cutting blade 140 move in respective directions opposite to the directions moved in the earlier stage of the full-cutting action. The cutter unit 100 returns to the initial condition. The cutter motor 105 stops driving, and the full-cutting action is completed.

In the following description, the gear train 124, the rotating body 150, the shaft 119, the first link member 110, the supporting shaft 129, the second link member 120, and the pins 113, 114 may be collectively called as a movable assembly 160 (see FIG. 4). The placement base 173, the shaft 177, and the movable holder 130 may be collectively called as a partial-cutting assembly 101 (see FIG. 4). Moreover, the shaft 199, the stationary blade 179, and the full-cutting blade 140 may be collectively called as a full-cutting assembly 180 (see FIG. 8). The partial-cutting assembly 101 and the full-cutting assembly 180 are located downstream and upstream, respectively, from each other in the conveying direction. The partial-cutting assembly 101 and the full-cutting assembly 180 are coupled with the cutter motor 105 through the movable assembly 160.

With reference to FIGS. 13-17, described below will be a detailed configuration of the ejection unit 200. FIG. 14 shows the ejection unit 200, in which illustration of a third frame 213, a guide frame 214, and a position-detector sensor 295 is omitted. The ejection unit 200 is located inside the body 2, at a position rearward with respect to the outlet 11 and downstream, i.e., frontward, with respect to the cutter unit 100 (see FIG. 2).

As shown in FIGS. 13 and 14, the ejection unit 200 includes an attachment frame 210, an ejection roller 220, an opposing roller 230, an ejection motor 299, a first coupling assembly 280, a movable assembly 250, a second coupling assembly 240, and the position-detector sensor 295. The attachment frame 210 is fixed to an interior structure in the body 2 at a rearward position with respect to the outlet 11. The attachment frame 210 includes a first frame 211, a second frame 212, and a third frame 213.

The first frame 211 is arranged at a lower position in the ejection unit 200 and extends orthogonally to the vertical direction. The second frame 212 and the third frame 213 extend upward from the first frame 211 orthogonally to the crosswise direction. The third frame 213 is arranged at a position leftward apart from the second frame 212 across a predetermined mount of clearance to face the second frame 212. The clearance between the second frame 212 and the third frame 213 forms the second passage 201. The second passage 201 aligns frontward with the first passage 118A and rearward with the outlet 11 (see FIGS. 16, 17). In other words, the second passage 201 is formed between the first passage 118A and the outlet 11 along the front-rear direction. The tape may be forwarded downstream, i.e., frontward, from the upstream side, i.e., the rear side, through the first passage 118A, the second passage 201, and the outlet 11, in this given order.

For example, if the tape is the receptor tape 5, the receptor tape 5 may travel through the first passage 118A, the second passage 201, and the outlet 11 with the base strip 51 facing rightward and the release paper 52 facing leftward. For another example, if the tape is the die-cut tape 9, the die-cut tape 9 may travel through the first passage 118A, the second passage 201, and the outlet 11 with the base pieces 91 facing rightward and the release paper 92 facing leftward.

The ejection roller 220 is located at a position downstream, i.e., frontward, from the conveyer roller 66 and the tape-driving shaft 61 and leftward with respect to the second passage 201 (see FIGS. 16 and 17). In other words, the ejection roller 220 is located to be closer to the release paper 52 rather than the base strip 51 in the receptor tape 5. The ejection roller 220 is a resilient piece in a cylindrical-shape axially extending in the vertical direction and is arranged inside an aperture 213A (see FIGS. 16 and 17). The aperture 213A is formed through a rear end portion of the third frame 213 in the crosswise direction in a rectangular shape elongated in the vertical direction in a side view.

The opposing roller 230 is located at a position downstream, i.e., frontward, in the conveying direction with respect to the conveyer roller 66 and the tape-driving shaft 61 and rightward with respect to the second passage 201 (see FIGS. 16 and 17). In other words, the opposing roller 230 is located to be closer to the base strip 51 rather than the release paper 52 in the receptor tape 5. The opposing roller 230 is arranged at a position rightward with respect to the ejection roller 220 across the second passage 201 to face the ejection roller 220. The opposing roller 230 includes a plurality of resilient pieces each having a cylindrical shape axially extending in the vertical direction and is arranged inside an aperture 212A. The cylindrical resilient pieces in the opposing roller 230 align in the vertical direction to be equally spaced apart from one another. The aperture 212A is formed through a rearward portion of the second frame 212 in the crosswise direction in a rectangular shape elongated in the vertical direction in a side view. A leftward end of the opposing roller 230 is located leftward with respect to a leftward surface of the second frame 212. The opposing roller 230 has a hole (unsigned) at an axial center thereof, and in the hole, rotatably inserted is a rotation shaft 230A. The rotation shaft 230A is a cylindrical rod axially extending in the vertical direction. An upper end and a lower end of the rotation shaft 230A are fixed to inner walls which are at an upper position and a lower position with respect to the aperture 212A.

The ejection motor 299 is a DC motor and is fixed to a leftward end portion of the first frame 211. An output shaft 299A of the ejection motor 299 extends rearward from the ejection motor 299. The ejection motor 299 may rotate the output shaft 299A in a counterclockwise direction, as indicated by an arrow R1, and in a clockwise direction, as indicated by an arrow R2, in a bottom view. In the following paragraphs, activating the ejection motor 299 to cause the output shaft 299A to rotate in the counterclockwise direction in the bottom view may be expressed as driving the ejection motor 299 in normal rotation, and activating the ejection motor 299 to cause the output shaft 299A to rotate in the clockwise direction in the bottom view may be expressed as driving the ejection motor 299 in reverse rotation.

The first coupling assembly 280 is located at a lower position in the ejection unit 200 and couples the ejection motor 299 with the ejection roller 220 drivably. The first coupling assembly 280 includes coupling gears 281-284, a movable gear 285, and a rotation shaft 285A. Rotation axes of the coupling gears 281-284 and the movable gear 285 extend in the vertical direction. The coupling gear 281 is a spur gear and is fixed to a lower end of the output shaft 299A.

The coupling gear 282 is located at front-rightward position with respect to the coupling gear 281 and is a two-stepped gear having a larger-diameter gear and a smaller-diameter gear. The coupling gear 282 meshes with the coupling gear 281. In particular, a rear-leftward end portion of the larger diameter gear in the coupling gear 282 meshes with a front-rightward end portion of the coupling gear 281. The coupling gear 282 is formed to have a hole at an axial center thereof, and a rotation shaft 282A is inserted therein. The rotation shaft 282A is a cylindrical rod fixed to the first frame 211 and extends downward from the first frame 211. The coupling gear 283 is located at a front-rightward position with respect to the coupling gear 282 and is a two-stepped gear having a larger-diameter gear and a smaller-diameter gear. The coupling gear 283 meshes with the coupling gear 282. In particular, a rear-leftward end portion of the larger-diameter gear in the coupling gear 283 meshes with a front-rightward portion of the smaller-diameter gear in the coupling gear 282. The coupling gear 283 is formed to have a hole at an axial center thereof, and a lower portion of a rotation shaft 283A is fixedly inserted therein. The rotation shaft 283A axially extends in the vertical direction through the first frame 211. An upper portion of the rotation shaft 283A extends to be higher than an upper surface of the first frame 211. The rotation shaft 283A is rotatably supported by the first frame 211. The upper portion of the rotation shaft 283A that is higher than the first frame 211 has a round cross-sectional shape, and another part of the rotation shaft 283A that is lower than the first frame 211 has a cross-sectional shape of "D."

The coupling gear 284 is located at a rightward position with respect to the coupling gear 283 and is a two-stepped gear having a larger-diameter gear and a smaller-diameter gear. The coupling gear 284 meshes with the coupling gear 283. In particular, a leftward portion of the larger-diameter gear in the coupling gear 284 meshes with a rightward portion of the smaller-diameter gear in the coupling gear 283. The coupling gear 284 is formed to have a hole at an axial center thereof, and a rotation shaft 284 is rotatably inserted therein. The rotation shaft 284A is a cylindrical rod fixed to the first frame 211 and axially extends downward from the first frame 211. The movable gear 285 is a spur gear and is located at a rearward position with respect to the coupling gear 284. The movable gear 285 meshes with the coupling gear 284. In particular, a frontward portion of the movable gear 285 meshes with a rearward portion of the smaller-diameter gear in the coupling gear 284. A rotation shaft 285A of the movable gear 285 axially extends in parallel with the rotation shaft 230A of the opposing roller 230. A lower portion of the rotation shaft 285A has a cross-sectional shape of "D," and a remainder portion of the rotation shaft 285A has a round cross-sectional shape. The lower portion of the rotation shaft 285A extends to be lower than the first frame 211 and is fixedly inserted in a hole at an axial center of the movable gear 285. An upper portion of the rotation shaft 285A extends to an upper end of the aperture 213A in the third frame 213 and is fixedly inserted in a hole at an axial center of the ejection roller 220.

The first frame 211 includes a guide hole 211A. The guide hole 211A is formed through a part of the first frame 211 rearward with respect to the coupling gear 284 in the vertical direction. The guide hole 211A extends in an arc along an outer circumferential surface 284B of the coupling gear 284, on which teeth (not shown) are formed, in a plan view (see FIG. 17). In FIG. 17, a part of the guide hole 211A which are covered by another parts, e.g., the ejection roller 220, is indicated by broken lines. In the guide hole 211A, inserted is the upper portion of the rotation shaft 285A that is higher than the movable gear 285. The rotation shaft 285A is movable in the guide hole 211A along an inner edge of the guide hole 211A.

The movable assembly 250 may move the ejection roller 220 in directions to be closer rightward to and farther leftward from the opposing roller 230. In the present embodiment, the movable assembly 250 may move the ejection roller 220 between a rightward position closer to the opposing roller 230 (see FIGS. 13 and 16) and a leftward position separated from the opposing roller 230 (see FIGS. 14 and 17). In the following paragraphs, the former position closer to the opposing roller 230 and the latter position farther from the opposing roller 230 may be called as a nipping position and a releasing position, respectively, for the movable assembly 250.

The movable assembly 250 includes a rotating body 251, an eccentric member 252, and a roller holder 255. The rotating body 251 has a cylindrical shape and is located opposite to the coupling gear 283 across the first frame 211. The rotating body 251 is formed to have a hole at an axial center thereof, and an upper portion of the rotation shaft 283A is rotatably inserted therein. The eccentric member 252 has a cylindrical shape axially extending upward at an eccentric position with respect to the rotation shaft 283A. Therefore, the eccentric member 252 may rotate about the rotation shaft 283A in a plan view along with rotation of the rotating body 251.

The eccentric member 252 includes an enlarged portion 253, at which the eccentric member 252 is fixed to an upper surface of the rotating body 251. The enlarged portion 253 has a cross-section larger than a cross-section of the eccentric member 252 and has a semicircular shape in a plan view. The enlarged portion 253 includes a recessed portion 253A (see FIG. 13), which is recessed inward from an outer circumferential surface of the round part in the enlarged portion 253 toward the rotation shaft 283A, in other words, toward a rotation axis of the eccentric member 252. The recessed portion 253A is engageable with an urging member 297, which is a torsion spring fixed to a fixture portion 231B. The fixture portion 231B is located on a leftward surface of the third frame 213 at an upper-frontward position with respect to the rotating body 251. Ends of the urging member 297 extend rearward. When the enlarged portion 253 is located rightward with respect to the rotation shaft 283A, the recessed portion 253A is open rightward, and the ends of the urging member 297 may enter and engage with the recessed portion 253A (see FIG. 13). When the enlarged portion 253 is located leftward with respect to the rotation shaft 283A, the recessed portion 253A is open leftward, and the end of the urging member 297 are separated from the recessed portion 253A.

As shown in FIG. 15, the roller holder 255 includes a first member 260, a second member 270, and an urging member 256 (see FIG. 14). The first member 260 has an approximate shape of "C," which is open rightward in a front view. In an upper wall 260A and a lower wall 260B of the first member 260, formed are engageable holes 262, although solely one of the engageable hole 262 in the lower wall 260B is shown. The engageable hole 262 is formed through a leftward portion in the upper wall 260A and in the lower wall 260B vertically and has a rectangular shape elongated in the crosswise direction in a plan view along the vertical direction. The lower wall 260B has a recessed portion 263, which is recessed leftward from a rightward end of the lower wall 260B.

On a leftward wall 260C of the first member 260, arranged are a protrusive portion 265 and a detectable piece 269. The protrusive portion 265 protrudes frontward from a rightward portion on a frontward side of the leftward wall 260C. In the protrusive portion 265, formed is a first supporting hole 266. The first supporting hole 266 is an opening elongated in the front-rear direction and formed through the protrusive portion 265 in the vertical direction. In the first supporting hole 266, inserted is the eccentric member 252 (see FIG. 13). The first supporting hole 266 supports the eccentric member 252 movably in the front-rear direction. The detectable piece 269 extends leftward from a leftward surface in an upper portion of the leftward wall 260C and turns to further extend upward.

The second member 270 has an approximate shape of "C," which is open rightward in a front view. The second member 270 is smaller than the first member 260 and is nested inside a dented area in the "C" shape of the first member 270. In a dented area of the "C" shape of the second member 270, in other words, in an area between an upper wall 270A and a lower wall 270B in the second member 270, located is the ejection roller 220 (see FIG. 14). A rightward end of the second member 270 forms the rightward end of the roller holder 255. The rightward end of the ejection roller 220 is located rightward with respect to the rightward end of the roller holder 255. The upper wall 270A and the lower wall 270B each has a second supporting hole 271. The second supporting hole 271 is formed through a leftward portion in the upper wall 270A and in the lower wall 270B vertically along the vertical direction and has a rectangular shape elongated in the front-rear direction in a plan view. In the second supporting holes 271, inserted is the rotation shaft 285A of the movable gear 285. The rotation shaft 285A supported in the second supporting holes 271 is rotatable and movable in the front-rear direction.

The upper wall 270A and the lower wall 270B each has an engageable tip 274. In FIG. 14, solely the engageable tip 274 in the lower wall 270B is shown while the engageable tip in the upper wall 270A is omitted. The engageable tip 274 protrudes leftward from a leftward end of the upper wall 270A and of the lower wall 270B and includes a claw. The claws in the engageable tips 274 on the upper wall 270A and the lower wall 270B protrude outward from each other, i.e., upward and downward, respectively. Each claw in the engageable tip 274 engages with the engageable hole 262 movably in the crosswise direction. Therefore, the second member 270 is supported by the first member 260 movably in the crosswise direction, in other words, in directions to be closer to and farther from the opposing roller 230.

As shown in FIG. 14, the urging member 256 is arranged between a rightward surface of the leftward wall 260C and a leftward surface of a leftward wall 270C of the second member 270. The urging member 256 is a compressed coil spring, which may urge the second member 270 with respect to the first member 260 rightward at the opposing roller 230. Therefore, with an urging force of the urging member 256, and when no leftward force is applied to the second member 270, the second member 270 may be maintained by the urging force of the urging member 256 at a position, where the claws in the engageable tips 274 contact rightward ends of the engageable holes 262.

As shown in FIGS. 13, 16, and 17, the roller holder 255 is arranged at a rearward position on the leftward surface of the third frame 213, inside the guide frame 214. The guide frame 214 extends leftward from the third frame 213 and has an approximately rectangular shape that encloses the roller holder 255 in a side view from the left. The guide frame 214 includes openings 214A, 214B. The guide frame 214 is open frontward through the opening 214A, which is at a lower-frontward corner in the guide frame 214. Through the opening 214, protrudes the protrusive portion 265 frontward from the guide frame 214. The guide frame 214 is open leftward through the opening 214B, which is at a leftward end of the guide frame 214. Through the opening 214B, protrudes the detectable piece 269 leftward. The guide frame 214 may guide the roller holder 255 to move linearly in the crosswise direction.

As shown in FIGS. 13 and 14, the second coupling assembly 240 is arranged at a lower position in the ejection unit 200 and couples the ejection motor 299 with the movable assembly 250 drivably. The second coupling assembly 240 includes a plurality of coupling gears 281-283, a rotation shaft 283A, and a one-way clutch 290. In other words, the coupling gears 281-283 couples the ejection motor 299 with the ejection roller 220 drivably and with the movable assembly 250 drivably.

The one-way clutch 290 is arranged between an inner wall of the rotating body 251 and an upper end of the rotation shaft 283A. In FIG. 13, the one-way clutch 290 and a part of the rotation shaft 283A that is located inside the coupling gear 283, the first frame 211, and the rotating body 251 are drawn in broken lines.

The one-way clutch 290 may couple the ejection motor 299 with the rotating body 251 when the ejection motor 299 drives in the reverse rotation and may separate the ejection motor 299 from the rotating body 251 when the ejection motor 299 drives in the normal rotation. In the present embodiment, when the ejection motor 299 drives in the reverse rotation, as indicated by an arrow R2, the rotation shaft 283A may be moved by the driving force through the coupling gear 281-283 to rotate in the clockwise direction in the bottom plan view. Meanwhile, when the ejection motor 299 drives in the normal rotation, as indicated by an arrow R1, the one-way clutch 290 may be moved through the coupling gears 281-283 to rotate in the counterclockwise direction in the bottom plan view. While the one-way clutch 290 is moved to rotate in the counterclockwise direction in the bottom plan view, the rotating body 251 is separated from the ejection motor 299 and idles with respect to the rotation shaft 283A.

As shown in FIG. 13, the position-detector sensor 295 is fixed to the leftward surface of the third frame 213 at an upper position with respect to the guide frame 214. The position-detector sensor 295 is a switch sensor and includes a movable piece 295A, which is arranged on a rightward position with respect to an upper portion of the detectable piece 269. The movable piece 295A is urged leftward at all time and may be maintained at a predetermined stopper position. When the movable piece 295A swings leftward to a predetermined movable position, the position-detector sensor 295 may output a detector signal. The position-detector sensor 295 may detect presence or absence of the ejection roller 220 at the nipping position.

With reference to FIGS. 13 and 14, described below will be motions of the movable members in the ejection unit 200 when the ejection motor 299 drives in the normal rotation. A driving force from the ejection motor 299 when the ejection motor 299 drives in the normal rotation may be transmitted from the output shaft 299A by the first coupling assembly 280 to the ejection roller 220 through the coupling gears 281, 282, 283, 284, the movable gear 285, and the rotation shaft 285A, in this given order. In the following paragraphs, the driving force from the ejection motor 299 when the ejection motor 299 drives in the normal rotation, as indicated by the arrow R1, may be called as a normal driving force from the ejection motor 299. When the ejection motor 299 is in the normal rotation, the ejection roller 220 may rotate in the counterclockwise direction in the bottom plan view, as indicated by an arrow R3. In the following paragraphs, the counterclockwise direction for the ejection roller 220 to rotate in the bottom plan view may be called as an ejecting direction. When the tape contacts the ejection roller 220 rotating in the ejecting direction, the tape may be forwarded.

The normal driving force from the ejection motor 299 may be, moreover, transmitted from the output shaft 299A by the second coupling assembly 240 through the coupling gears 281, 282, 283, and the rotation shaft 283A in this given order. Meanwhile, the one-way clutch 290 disconnects the rotating body 251 from the ejection motor 299 so that the normal driving force from the ejection motor 299 may not be transmitted from the rotation shaft 283A to the rotating body 251. Therefore, the printing apparatus 1 may drive the ejection roller 220 to rotate in the ejecting direction by driving the ejection motor 299 in the normal rotation while the position of the ejection roller 220 is maintained steadily. In other words, the printing apparatus 1 may drive the ejection roller 220 to rotate in the ejecting direction by driving the ejection motor 299 in the normal rotation without causing the ejection roller 220 to move between the nipping position (see FIGS. 13 and 16) and the releasing position (see FIGS. 14, 17).

With reference to FIGS. 13, 14, 16, and 17, described below will be motions of the movable members in the ejection unit 200 when the ejection motor 299 drives in the reverse rotation. As shown in FIGS. 13 and 14, a driving force from the ejection motor 299 when the ejection motor 299 drives in the reverse rotation may be transmitted from the output shaft 299A by the first coupling assembly 280 to the ejection roller 220 through the coupling gears 281, 282, 283, 284, the movable gear 285, and the rotation shaft 285A, in this given order. In the following paragraphs, the driving force from the ejection motor 299 when the ejection motor 299 drives in the reverse rotation, as indicated by the arrow R2, may be called as a reverse driving force from the ejection motor 299. When the ejection motor 299 is in the reverse rotation, the ejection roller 220 may rotate in the clockwise direction, which is an opposite direction to the ejecting direction, in the bottom plan view, as indicated by an arrow R4. In the following paragraphs, the clockwise direction for the ejection roller 220 to rotate in the bottom plan view may be called as a withdrawal direction.

The reverse driving force from the ejection motor 299 may be, moreover, transmitted from the output shaft 299A by the second coupling assembly 240 through the coupling gears 281, 282, 283, and the rotation shaft 283A in this given order. Meanwhile, the one-way clutch 290 connects the rotating body 251 with the ejection motor 299 so that the reverse driving force from the ejection motor 299 may be transmitted from the rotation shaft 283A to the rotating body 251. Therefore, when the ejection motor 299 drives in the reverse rotation, the rotating body 251 may rotate about the rotation shaft 283A in the clockwise direction in the bottom plan view. Along with the rotation of the rotating body 251, the eccentric member 252 may rotate about the rotation shaft 283A in the clockwise direction in the bottom plan view.

Meanwhile, as shown in FIGS. 16 and 17, the eccentric member 252 may move in the first supporting hole 266 in the front-rear direction, pressing the protrusive portion 264 leftward or rightward. Therefore, the roller holder 255 may move in the guide frame 214 along the guide frame 214 leftward or rightward. As the roller holder 255 moves leftward or rightward, the second supporting hole 271 (see FIG. 15) may press the rotation shaft 285A leftward or rightward through an inner surface thereof and the recessed portion 263 (see FIG. 15). As the rotation shaft 285A moves leftward or rightward, the ejection roller 220 may move between the nipping position and the releasing position. Thus, the printing apparatus 1 may cause the ejection roller 220 to move between the nipping position (see FIG. 16) and the releasing position (see FIG. 17) through the movable assembly 250 by driving the ejection motor 299 in the reverse rotation.

When the ejection roller 220 moves between the nipping position and the releasing position, the rotation shaft 285A may move in the second supporting hole 271 (see FIG. 15) in the front-rear direction and along the inner edge of the guide hole 211A. In other words, the rotation shaft 285A may move along the outer circumferential surface 284B of the coupling gear 284. Therefore, when the ejection roller 220 moves from the releasing position to the nipping position, the ejection roller 220 may approach the opposing roller 230 from a leftward-frontal position with respect to the opposing roller 230 (see FIG. 17). Meanwhile, the movable gear 285 may move integrally with the rotation shaft 285A along the outer circumferential surface 284B of the coupling gear 284. Therefore, the movable gear 285 may move with the teeth thereof maintained meshed with the teeth of the coupling gear 284. Thus, while the ejection motor 299 and the ejection roller 220 are maintained coupled drivably with each other through the first coupling assembly 280, the ejection roller 220 is movable between the nipping position and the releasing position. In other words, regardless of positions of the ejection roller 220 between the nipping position and the releasing position, the ejection motor 299 and the ejection roller 220 may be drivably coupled with each other through the first coupling assembly 280.

When the ejection roller 220 is at the nipping position, the ejection roller 220 may, together with the opposing roller 230, nip the tape at the position between the ejection roller 220 and the opposing roller 230. When no tape is present at the position between the ejection roller 220 and the opposing roller 230, the ejection roller 220 may contact the opposing roller 230. Alternately, the ejection roller 220 may be placed to face the opposing roller 230 at a position apart from the opposing roller 230 for a distance smaller than the thickness of the tape. When the ejection roller 220 is at the releasing position, the ejection roller 220 may be separated leftward from the tape. In the following paragraphs, the position of the ejection roller 220 in the conveying direction to nip the tape between the ejection roller 220 and the opposing roller 230 may be called as a second nipping position P5. A load to be applied to the tape between the ejection roller 220 and the opposing roller 230 may be called as a nipping load at the second nipping position P5. The second nipping position P2 is located downstream from the second cutter position P4 in the conveying direction. The nipping load at the second nipping position P5 is smaller than the nipping load at the first nipping position P2.

Specifically, as shown in FIG. 17, when the eccentric member 252 is at a leftward position with respect to the rotation shaft 283A, the eccentric member 252 is located at a leftward end within the crosswise movable range for the eccentric member 252. Meanwhile, the roller holder 255 is at a leftward end within the crosswise movable range for the roller holder 255, and the ejection roller 220 is at the releasing position. With this arrangement, as the eccentric member 252 rotates about the rotation shaft 283A in the counterclockwise direction in the plan view, the eccentric member 252 may move rearward in the first supporting hole 266 and press the protrusive portion 265 rightward. Meanwhile, the first member 260, the second member 270, and the ejection roller 220 may move integrally rightward until the ejection roller 220 reaches the nipping position, in other words, until the ejection roller 220 is located to the position to nip the tape at the position between the ejection roller 220 and the opposing roller 230.

According to the present embodiment, as shown in FIG. 16, before the eccentric member 252 reaches a rightward end in the crosswise movable range for the eccentric member 252, the ejection roller 220 is located at the nipping position, where the ejection roller 220 and the opposing roller 230 may nip the tape. After the ejection roller 220 is located at the nipping position, the eccentric member 252 moves to the rightward end in the crosswise movable range for the eccentric member 252, and the first member 260 may move rightward. Meanwhile, the second member 270 and the ejection roller 220 are restricted by the opposing roller 230 from moving rightward. Therefore, the first member 260 may move closer to the second member 270 and the ejection roller 220 against the urging force from the urging member 256. In this regard, when the eccentric member 252 moves leftward or rightward between the crosswise ends of the crosswise movable range for the eccentric member 252, a moving amount for the first member 260 in the crosswise direction is greater than a moving amount for the first ejection roller 220 and for the second member 270 in the crosswise direction.

As the first member 260 approaches the second member 270 and the ejection roller 220 against the urging force of the urging member 256, the urging force of the urging member 256 that may urge the ejection roller 220 against the opposing roller 230 may increase. Thus, the printing apparatus 1 may adjust the nipping load at the second nipping position P2 according to the crosswise position of the eccentric member 252. When the ejection roller 220 is at the nipping position, the opposing roller 230 may move to be closer to or farther relatively to the first member 260 according to the thickness of the tape. In this regard, when the tape is thicker, the second member 270 moves closer to the first member 260. Therefore, the printing apparatus 1 may apply different intensity of nipping load at the second nipping position P5 depending on the thickness of the tape.

As shown in FIG. 13, when the ejection roller 220 is at the nipping position, the enlarged portion 253 is located at a rightward position with respect to the rotation shaft 283A, and the urging member 297 engages with the recessed portion 253A. In this arrangement, the urging member 297 urges the enlarged portion 253 obliquely leftward and frontward. In other words, the urging member 297 may urge the rotating body 251 counterclockwise in the bottom plan view. Thus, the urging member 297 may restrict the rotating body 251 from rotating clockwise in the bottom plan view so that the ejection roller 220 may be restricted from moving from the nipping position to the releasing position. The urging force of the urging member 297 is less intense than a force required in rotating the rotating body 251 counterclockwise in the plan view. Therefore, the ejection roller 220 may be maintained at the nipping position by the urging force of the urging member 297.

When the ejection roller 220 is at the releasing position, the detectable piece 269 is separated leftward from the movable piece 295A. As the ejection roller 220 moves from the releasing position to nipping position, the detectable piece 269 may press the movable piece 295A rightward. When the ejection roller 220 reaches the nipping position, the movable piece 295A being pressed rightward by the detectable piece 269 may swing to the movable position. According to the present embodiment, when the eccentric member 252 is located at the rightward end within the crosswise movable range for the eccentric member 252, the detectable piece 269 is located at the rightward end in the crosswise movable range for the detectable piece 269, and the movable piece 295A is located at the movable position. Therefore, the position-detector sensor 295 may detect the ejection roller 220 located at the nipping position or another position by detecting the position of the detectable piece 269 within the crosswise movable range for the detectable piece 269.

With reference to FIG. 18, described in the following paragraphs will be an electrical configuration of the printing apparatus 1. The printing apparatus 1 has a CPU 81, which serves as a processor to execute a main process described further below and controls actions in the printing apparatus 1. The CPU 81 is connected with a flash memory 82, a ROM 83, a RAM 84, the thermal head 60, the conveyer motor 68, the cutter motor 105, the ejection motor 299, the input interface 4, the position-detector sensor 295, the mark-detector sensor 31, and a tape-detector sensor 32. The flash memory 82 is a non-volatile memory medium and may store programs that enable the CPU 81 to conduct the main process. The ROM 83 is a non-volatile memory medium and may store various types of parameters that are used by the CPU 81 in order to execute the programs. The RAM 84 is a volatile memory medium to store temporary information such as data for a timer and a counter.

The tape-detector sensor 32 is located at a position downstream from the tape-driving shaft 61 and the conveyer roller 66 and upstream from the ejection roller 220 in the conveying direction. The tape-detector sensor 32 is a transmissive photo-sensor and may detect presence or absence of the tape at a predetermined detector position (not shown) between the first nipping position P2 and the second nipping position P5 in the conveying direction. The tape-detector sensor 32 may output a detector signal when the tape is present at the detector position.

With reference to FIGS. 19 through 24, described in the following paragraphs will be the main process. A user may place the printing apparatus 1 in the print-ready condition and power the printing apparatus 1 on. When the printing apparatus 1 is powered on, the CPU 81 calls the program from the flash memory 82 in the RAM 84 to start the main process.

As shown in FIG. 19, in S11, the CPU 81 conducts an initial process. In particular, the CPU 81 places the cutter motor 105 in the initial condition and drives the ejection motor 299 in the reverse rotation to place the ejection unit 200 in the initial condition. When the ejection unit 200 is in the initial condition, the ejection roller 220 is located at the releasing position. The CPU 81 may determine that the ejection unit 200 is in the initial condition by receiving no detector signal from the position-detector sensor 295. Alternatively, the CPU 81 may determine that the ejection unit 200 is in the initial condition when the ejection roller 220 is at the nipping position. The CPU 81 clears information stored in the RAM 84, if any. The CPU 81 may input "0 (zero)" as a value K for a printing action history counter, which is stored in the RAM 84 to count a number of printing actions executed previously.

In S12, the CPU 81 obtains tape information. The tape information indicates a type of the tape, which includes for example, the receptor tape 5, the die-cut tape 9, the thermosensitive tape, the transparent film tape, the double-face adhesive tape, etc., and may be input by the user through the input interface 4. The user may input the tape information depending on the type of the tape contained in the cassette to be used. The obtained tape information is stored in the RAM 84.

In S13, the CPU 81 determines whether the type of the tape indicated by the obtained tape information is the die-cut tape 9. If the tape information indicates a type other than the die-cut tape 9 (S13: NO), the flow proceeds to S21.

The thickness in the die-cut tape 9 differs along the longitudinal direction, or in the conveying direction, depending on the presence or absence of the base piece 91 therein. In other words, a difference in thickness is caused between a thicker part of the die-cut tape 9 where the base piece 91 is present and a thinner part of the die-cut tape 9 where the base piece 91 is absent. In the thinner part of the die-cut tape 9 where the base piece is absent, cross sections of the base piece 91 and the adhesive layer 93 are exposed within the cassette. Therefore, if a loose end of the die-cut tape 9, i.e., a downstream end of the die-cut tape 9 in the conveying direction, flips within the cassette attached to the attachment room 6, the edge 179C of the stationary blade 179 may contact the cross section of the adhesive layer 93. In this regard, if the edge 179C of the stationary blade 179 contacts the adhesive layer 93, the adhesive layer 93 may adhere to the edge 179C of the stationary blade 179 and may be separated from the release paper 92 together with the base piece 91. In this occasion, the die-cut tape 9 may be undesirably unrolled to extend outside the cassette due to weight thereof even if the conveyer motor 68 stays inactive or not driving in the normal rotation.

In this regard, if the tape indicated by the type information is the die-cut tape 9 (S13: YES), in S14, the CPU 81 drives the ejection motor 299 in the reverse rotation to start moving the ejection roller 220 for the nipping position (see FIG. 16). When the CPU 81 obtains the detector signal from the position-detector sensor 295, in S15, the CPU 81 stops driving the ejection motor 299 to stop the ejection roller 220 at the nipping position. Thus, by nipping the die-cut tape 9 between the ejection roller 220 and the opposing roller 230, the loose end of the die-cut tape 9 may be restricted from flipping. Therefore, separation of the base piece 91 from the release paper 92 in the die-cut tape 9 may be restrained. Moreover, by nipping the die-cut tape 9 between the ejection roller 220 and the opposing roller 230, the die-cut tape 9 may be restrained from moving downstream in the conveying direction from the second nipping position P5. Therefore, the die-cut tape 9 may be restrained from being ejected undesirably outside the cassette. As described earlier, the position-detector sensor 295 outputs the detector signal when the ejection roller 220 is located at the nipping position; therefore, based on the detector signal from the position-detector sensor 295, the CPU 81 may correctly stop the ejection roller 220 at the nipping position.

In S21, the CPU 81 obtains a print quantity, which is a number of times to repeat a printing action in the printing apparatus 1. The print quantity is input by the user through the input interface 4. The obtained print quantity is stored in the RAM 84. In S22, the CPU 81 obtains a print command, which is input by the user through the input interface 4. The print command contains print data. In S23, the CPU 81 calculates an ejection-stop period. The ejection-stop period is a difference between printing duration, which is a length of time between start of a printing action and stop of the printing action, and a predetermined standard time period. The standard time period is shorter than a motor driving period, which is a length of time to drive the ejection motor 299 in the reverse rotation to move the ejection roller 220 from the nipping position to the releasing position. In other words, the motor driving period is a length of time required by the ejection motor 299 to drive in the reverse rotation to move the eccentric member 252 from the rightward end to the leftward end, or from the leftward end to the rightward end, of the crosswise movable range for the eccentric member 252. The standard time period and the motor driving period are prepared in advance and stored in the ROM 83. Optionally, the standard time period may be adjustable within a range that does not exceed the motor driving period. The calculated ejection-stop period is stored in the RAM 84.

In S24, the CPU 81 determines whether the type of the tape indicated in the tape information obtained in S12 is the die-cut tape 9. If the tape information indicates a type other than the die-cut tape 9 (S24: NO), in S25, the CPU 81 conducts a first cueing process. Meanwhile, if the tape information indicates the die-cut tape 9 (S24: YES), in S26, the CPU 81 conducts a second cueing process. Following the first cueing process or the second cueing process, the flow proceeds to S61 (see FIG. 20).

With reference to FIG. 22, described below will be the first cueing process. In the first cueing process, a tape other than the die-cut tape 9, which may be, for example, the receptor tape 5, the thermosensitive tape, the stencil tape, the laminated tape, is cued to be placed in a predetermined position in the conveying direction.

In S31, the CPU 81 starts driving the conveyer motor 68 in the reversing direction to reverse the tape. Thereby, a length of a part of the tape extended downstream from the thermal head 60 in the conveying direction is reduced. In S32, the CPU 81 reverses the tape for a predetermined time in the reversing action and stops the conveyer motor 68 to stop reversing the tape. In S33, the CPU 81 determines based on the detector signal from the tape-detector sensor 32 whether the tape is located at the detector position. The tape-detector sensor 32 may output the detector signal when the loose end of the tape, i.e., the downstream end of the tape in the conveying direction, is located downstream from the detector position in the conveying direction (S33: YES). The flow returns to the main process (see FIG. 19).

Meanwhile, when the loose end of the tape is located upstream from the detector position in the conveying direction, the tape-detector sensor 32 does not output the detector signal (S33: NO). Without the detector signal from the tape-detector sensor 32, in S34, the CPU 81 starts driving the ejection motor 299 in the normal rotation to rotate the ejection roller 220 in the ejecting direction. Thereby, the ejection roller 220 rotates in the ejecting direction, as indicated by the arrow R3 (see FIG. 17), at the releasing position. Although the tape is separated from the ejection roller 220 when the ejection roller 220 rotates at the releasing position, the tape is nipped at the first nipping position P2 between the conveyer roller 66 and the tape-driving roller 72. Therefore, the tape may not be forwarded.

In S35, the CPU 81 starts driving the conveyer motor 68 to rotate in the forwarding direction to forward the tape. In this condition, the ejection roller 220 may contact the tape; however, the ejection roller 220 rotating in the ejecting direction as indicated by the arrow R3 may not interfere with the tape being forwarded (see FIG. 17). When the CPU 81 obtains the detector signal from the tape-detector sensor 32, in S36, the CPU 81 stops driving the conveyer motor 68 to stop forwarding the tape. Therefore, the loose end of the tape is located at the detector position for the tape-detector sensor 32 or a position downstream from the detector position in the conveying direction. In S37, the CPU 81 stops normal rotation of the ejection motor 299 to stop rotation of the ejection roller 220. The flow returns to the main process.

In the first cueing process, the length of the part of the tape that is located downstream from the printing position P1 in the conveying direction may be reduced. Therefore, an amount of the tape to be left blank without having any character printed thereon may be reduced. Moreover, the loose end of the tape is located at the detector position for the tape-detector sensor 32 or a position downstream from the detector position in the conveying direction. Meanwhile, the detector position is located downstream from the first nipping position P2 in the conveying direction. Therefore, a potential conveyance error, which may unless otherwise be caused by the tape not being nipped at the first nipping position P2, may be restrained.

With reference to FIGS. 23A-23B, described in the following paragraphs will be the second cueing process. In the second cueing process, the die-cut tape 9 is cued and placed in a predetermined position in the conveying direction. In the following paragraphs, steps that are different from those in the first cueing process may be specifically described.

As shown in FIG. 23A, in S41, the CPU 81 starts driving the ejection motor 299 in the reverse rotation to move the ejection roller 220 to the releasing position. The CPU 81 drives the ejection motor 299 in the reverse rotation for the motor driving period, and in S42, stops driving the ejection motor to stop the ejection roller 220 at the releasing position. Optionally, the ejection motor 299 may be a stepping motor. If the ejection motor 299 is a stepping motor, the CPU 81 may control a rotation amount of the ejection motor 299 being driven in the reverse rotation, starting from a point where the ejection roller 220 is at the nipping position in order to stop the ejection roller 220 at the releasing position.

Steps in S43 through S49 may be conducted similarly to those in S31 through S37 in the first cueing process described earlier. In S51 (see FIG. 23B), the CPU 81 determines whether the mark-detector sensor 31 detected a mark 99 while the die-cut tape 9 is being reversed (S43-S44) or forwarded (S47-S48). The mark-detector sensor 31 outputs the detector signal when the mark 99 is detected. Therefore, if the CPU 81 obtains the detector signal from the mark-detector sensor 31 while the die-cut tape 9 is being conveyed (SM: YES), the flow proceeds to S56.

If the CPU 81 obtains no detector signal from the mark-detector sensor 31 while the die-cut tape 9 is being conveyed (S51: NO), in S52, the CPU 81 starts driving the ejection motor 299 in the normal rotation to rotate the ejection roller 220 in the ejecting direction. Thereby, the ejection roller 220, staying at the releasing position, rotates in the ejecting direction, as indicated by the arrow R3 (see FIG. 17). In S53, the CPU 81 starts driving the conveyer motor 68 to rotate in the forwarding direction to forward the die-cut tape 9. When the CPU 81 obtains the detector-signal from the mark-detector sensor 31, in S54, the CPU 81 stops the normal rotation of the conveyer motor 68 to stop forwarding the die-cut tape 9. In S55, the CPU 81 stops the normal rotation of the ejection motor 299 to stop the rotation of the ejection roller 220.

In S56 (see FIG. 23A), the CPU 81 calculates a corrected forwarding amount, which is an amount to forward the die-cut tape 9 to locate the base piece 91 in the die-cut tape 9 to the printing position P1. As mentioned earlier, the base pieces 91 and the marks 99 are arranged at the equal intervals in the die-cut tape 9. Therefore, the CPU 81 may calculate the corrected forwarding amount based on a position of the die-cut tape 9 in the conveying direction when the mark-detector sensor 31 detected the mark 99. The calculated corrected forwarding amount is stored in the RAM 84.

In S57, the CPU 81 starts driving the ejection motor 299 in the normal rotation to rotate the ejection roller 220 in the ejecting direction. Thereby, the ejection roller 220, staying at the releasing position, rotates in the ejecting direction, as indicated by the arrow R3 (see FIG. 17). In S58, the CPU 81 starts driving the conveyer motor 68 to rotate in the forwarding direction to forward the die-cut tape 9. The CPU 81 forwards the die-cut tape 9 for the corrected forwarding amount calculated in S56, and in S59, stops the rotation of the conveyer motor 68 to stop forwarding the die-cut tape 9. Thereby, one of the base pieces 91 in the die-cut tape 9 is located at the printing position P1. Thus, a situation, in which a character is printed in an area between two adjoining base pieces 91 in the die-cut tape 9, may be prevented. In other words, a character may not be printed on the release paper 92. In S60, the CPU 81 stops driving the ejection motor 299 to stop the rotation of the ejection roller 220. The flow returns to the main process (see FIG. 19).

In the main process, the flow proceeds to S61 (see FIG. 20). As shown in FIG. 20, in S61, the CPU 81 starts driving the ejection motor 299 in the normal rotation to rotate the ejection roller 220 in the ejecting direction. Thereby, the ejection roller 220, staying at the releasing position, rotates in the ejecting direction, as indicated by the arrow R3 (see FIG. 17). In this arrangement, in S62, the CPU 81 starts a printing action. In particular, the CPU 81 starts driving the conveyer motor 68 in the forwarding direction and controls the heating elements in the thermal head 60 to generate heat. Thereby, characters may be printed in lines on the tape being forwarded.

In S63, the CPU 81 determines whether the eject-stop period calculated in S23 elapsed since starting of the printing action in S62. If the eject-stop period is not elapsed (S63: NO), the CPU 81 waits until the eject-stop period elapses. If the eject-stop period elapsed (S63: YES), in S64, the CPU 81 stops driving the ejection motor 299 in the normal rotation to stop the rotation of the ejection roller 220. Thereby, the rotation of the ejection roller 220 in the ejecting direction is stopped during the printing action. In S65, the CPU 81 starts driving the ejection motor 299 in the reverse rotation to start moving the ejection roller 220 for the nipping position (see FIG. 16). In other words, the ejection roller 220 starts moving for the nipping position while the printing action is being conducted. As the length of the standard period is shorter than the length of the motor-driving period, the ejection roller 220 may not move for the nipping position during the ongoing printing action.

In S66, the CPU 81 stops the printing action. In particular, the CPU 81 stops controlling the thermal head 60, and thereafter, stops driving the conveyer motor 68. Thereby, printing on the tape is stopped, and thereafter, the forwarding action is stopped. More specifically, if the tape is to be fully cut in the full-cutting action after the printing action, the CPU 81 stops forwarding the tape so that a position to be cut is placed at the first cutter position P3. On the other hand, if the tape is to be partially cut in the partial-cutting action after the printing action, the CPU 81 stops forwarding the tape so that the position to be cut is placed at the second cutter position P4. Moreover, when the tape is the die-cut tape 9, and if the tape is to be fully cut in the full-cutting action after the printing action, the CPU 81 specifies a position of the mark 99 in the conveying direction based on the detector signal from the mark-detector sensor 31, and based on the specified position of the mark 99 in the conveying direction, the CPU 81 stops forwarding the die-cut tape 9 so that the intermediate area between the adjoining base pieces 91 in the die-cut tape 9 may be placed at the first cutter position P3.

In S67, the CPU 81 adds one (1) to the value K in the printing action history counter. When the CPU 81 obtains the detector signal from the position-detector sensor 295, in S68, the CPU 81 stops driving the ejection motor 299 in the reverse rotation to stop the ejection roller 220 at the nipping position.

As shown in FIG. 21A, in S71, the CPU 81 refers to a rotation amount determining table 30 (see FIG. 24) and determines a pre-cut rotation amount for the ejection roller 220. The pre-cut rotation amount for the ejection roller 220 is a rotation amount for the ejection roller 220 to rotate in S75 and S76, which will be described further below.

As shown in FIG. 24, in the rotation amount determining table 30, types of the tapes are associated with the pre-cut rotation amounts for the ejection roller 22. In FIG. 24, for the purpose to simplify the explanation, the pre-cut rotation amounts for the ejection roller 220 are classified into "large," "medium," "small," and "none." The pre-cut rotation amount "large" is larger than the pre-cut rotation amount "medium," and the precut rotation amount "medium" is larger than the pre-cut rotation amount "small" The pre-cut rotation amount "small" is larger than "none." The pre-cut rotation amount "none" indicates no rotation of the ejection roller 220. In other words, the ejection roller 220 is controlled not to rotate at all.

In the present embodiment, the receptor tape 5 and the thermosensitive tape are associated with the amount "large," the laminated tape is associated with the amount "medium," and the stencil tape is associated with the amount "small." The die-cut tape 9 is associated with the amount "none." In this regard, the rotation amount determining table 30 defines, except for the die-cut tape 9, a larger pre-cut rotation amount for the more flexible tapes and a smaller pre-cut rotation amount for the less flexible tapes. In S71, based on the tape information obtained in S12 and with reference to the rotation amount determining table 30, the CPU 81 determines the pre-cut rotation amount for the ejection roller 220 associated with the type of the tape. The determined pre-cut rotation amount for the ejection roller 220 is stored in the RAM 84.

As shown in FIG. 21A, in S72, the CPU 81 determines whether the determined pre-cut rotation amount for the ejection roller 220 is "none." For example, if the tape is the die-cut tape 9, the pre-cut rotation amount for the ejection roller 220 is determined to be "none" (S72: NONE). The flow proceeds to S81.

Meanwhile, for example, if the tape is a tape other than the receptor tape 5, which may be, for example, one of the thermosensitive tape, the stencil tape, or the laminated tape, in S72, the pre-cut rotation amount for the ejection roller 220 is not determined to be "none" (S72: OTHER). In S73, the CPU 81 determines whether the value K in the printing action history counter is "1." As described earlier, the value K in the printing action history counter is incremented by one in S67 (see FIG. 20) each time when a printing action is conducted. Therefore, after a first printing action, and before a second printing action, the value K in the printing action history counter should indicate "1" (S73: YES). The CPU 81 proceeds to S75.

After the second printing action, the value K in the printing action history counter should indicate "2" or larger (S73: NO). In S74, the CPU 81 corrects the pre-cut rotation amount for the ejection roller 220. In particular, the CPU 81 sets a corrected rotation amount for the ejection roller 220, which is smaller than the pre-cut rotation amount determined in S71 for a predetermined amount. The corrected rotation amount for the ejection roller 220 is prepared in advance for each of the pre-cut rotation amounts "large," "medium," and "small" to be smaller than the pre-cut rotation amounts "large," "medium," and "small," respectively, and stored in the ROM 83. The corrected rotation amount is saved in the RAM 84 as the pre-cut rotation amount for the ejection roller 220.

In S75, the CPU 81 starts driving the ejection motor 299 in the normal rotation to rotate the ejection roller 220 in the ejecting direction. Thereby, the ejection roller 220 rotates in the ejecting direction, as indicated by the arrow R3 (see FIG. 16), at the nipping position. In this arrangement, the nipping load at the second nipping position P5 is less intense than the nipping load at the first nipping position P2; therefore, the tape may not be forwarded. Accordingly, a tensile force to stretch the tape downstream in the conveying direction may be applied to the tape. In this regard, if the tape nipped between the ejection roller 220 and the opposing roller 230 is creased, the tape may be straightened. Thereby, the width of the tape aligns along the vertical direction so that the printing apparatus 1 may cut the tape correctly in S83 or S91, which will be described further below. Meanwhile, when the tape is the die-cut tape 9, as mentioned above, the steps in S75, S76 are skipped. Because the die-cut tape 9 is cut at the intermediate area between the adjoining base pieces 91 in the release paper 92, it may not be necessary that the position in the die-cut tape 9 to be cut is finely adjusted. In other words, even if the die-cut tape 9 is creased, straightening the crease may not be necessary.

The CPU 81 drives the ejection motor 299 to rotate the ejection roller 220 for the pre-cut rotation amount determined in S71 or corrected in S74, in other words, for the pre-cut rotation amount stored in the RAM 84, and in S76, stops driving the ejection motor 299 to stop the rotation of the ejection roller 220.

In S81, the CPU 81 determines whether the value K in the printing action history counter is equal to the print quantity obtained in S21 (see FIG. 19). The value K in the printing action history counter is smaller than the print quantity until the printing actions are repeated for the number of times equal to the print quantity (S81: NO). The flow proceeds to S82, and the CPU 81 determines whether the type of the tape indicated by the tape information obtained in S12 (see FIG. 19) is the die-cut tape 9 (S82). If the tape is the die-cut tape 9 (S82: YES), the flow returns to S24 (see FIG. 19).

If the tape is not the die-cut tape 9 (S82: NO), in S83, the CPU 81 controls the cutter motor 105 to conduct the partial-cutting action so that the tape nipped between the ejection roller 220 and the opposing roller 230 may be partially cut. In S84, the CPU 81 starts driving the ejection motor 299 in the reverse rotation to move the ejection roller 220 for the releasing position. The CPU 81 drives the ejection motor 299 in the reverse rotation for the motor driving period, and in S85, stops the reverse rotation of the ejection motor 299 to stop the ejection roller 220 at the releasing position. The flow returns to S24. Thus, the steps in S24-S76 may be repeated until the value K in the printing action history counter increases to be equal to the print quantity, in other words, until the quantity of printing actions indicated by the print quantity are completed.

When the number of printing actions equal to the print quantity are completed, the value K in the printing action history counter is equal to the print quantity (S81: YES). The flow proceeds to S91 (see FIG. 21B), and the CPU 81 controls the cutter motor 105 to conduct the full-cutting action so that the tape nipped between the ejection roller 220 and the opposing roller 230 may be fully cut. In this regard, because the second nipping position P5 is located downstream from the first cutter position P3 in the conveying direction, the tape cut off fully from the roll may be held between the ejection roller 220 and the opposing roller 230. In S92, the CPU 81 starts driving the ejection motor 299 in the normal rotation to rotate the ejection roller 220 in the ejecting direction. Thereby, the ejection roller 220 may rotate in the ejecting direction, as indicated by the arrow R3 (see FIG. 17), at the nipping position. Accordingly, the tape having been cut is forwarded and ejected outside the printing apparatus 1 through the outlet 11.

In S93, the CPU 81 stops driving the ejection motor 299 in the normal rotation at the timing depending on the length of the tape having been cut off to stop the rotation of the ejection roller 220. In particular, when an upstream end of the cutoff tape in the conveying direction reaches the second nipping position P5, the CPU 81 stops driving the ejection motor 299 in the normal rotation. Thereby, the upstream end of the cutoff tape may be nipped between the ejection roller 220 and the opposing roller 230. Accordingly, the cutoff tape may be held in a posture with the frontward end, or the downstream end, thereof protruding from the outlet 11 without falling off from the outlet 11 outside the printing apparatus 1. Alternatively, the user may pick up the cutoff tape after S93 and before S94, in other words, when the frontward or downstream end of the cutoff tape protrudes outward through the outlet 11. The flow returns to S11 (see FIG. 19).

As described above, the partial-cutting assembly 101 and the full-cutting assembly 180 may cut the tape by activating the cutter motor 105. The movable holder 130 in the partial-cutting assembly 101 is located rightward with respect to the conveyer path 12. Therefore, a leftward part of the attachment room 6 with respect to the passage area 6A and the movable range for the movable holder 130 overlap each other in the front-rear direction. Therefore, compared to the conventional arrangement of the attachment room 6 and the movable range of the movable holder 130, which are displaced from each other in the crosswise direction, a dimension of an area to arrange the attachment room 6 and the movable range for the movable holder 130 may be reduced in the crosswise direction. In this regard, the printing apparatus 1 may be downsized.

The movable holder 130 is movably arranged at the rightward position with respect to the conveyer path 12. The part of the attachment room 6 located rightward with respect to the conveyer path 12 and the movable area for the movable holder 130 overlap each other in the front-rear direction. Therefore, a dimension of an area to arrange the attachment room 6 and the movable range for the movable holder 130 may be reduced in the crosswise direction. In this regard, the printing apparatus 1 may be downsized.

The maximum length of the arm 141 in the circumferential direction for the swing motion of the full-cutting blade 140 to swing about the shaft 199 is smaller than the maximum length of the movable holder 130 in the circumferential direction for the swing motion of the movable holder 130 to swing about the shaft 177. In other words, the length of the arm 141 in the movable direction for the full-cutting blade 140 is smaller than the length of the movable holder 130 in the movable direction for the movable holder 130. Therefore, while the arm 141 is located leftward with respect to the conveyer path 12, potential influence caused by the dimension of the area increased in the crosswise direction to arrange the arm 141 and the attachment room 6 may be limited. In other words, influence to the volume of the printing apparatus 1 may be limited; therefore, the printing apparatus 1 may be downsized effectively.

The partial-cutting assembly 101 and the full-cutting assembly 180 may be driven to cut the tape depending on the direction to drive the cutter motor 105. In particular, the movable assembly 160 may move the partial-cutting blade 103 toward the placement base 173 by the driving force to drive the cutter motor 105 in one direction and move the full-cutting blade 140 toward the stationary blade 179 by the driving force to drive the cutter motor 105 in the opposite direction. In this regard, the tape may be cut partially or fully by the driving force of the single cutter motor 105 driving in the different rotating directions. Therefore, the printing apparatus 1 may be simplified.

The cutter motor 105 is located rightward with respect to the first passage 118A. In other words, the cutter motor 105 is located rightward with respect to the conveyer path 12. Therefore, a dimension of the area to arrange the attachment room 6 and the cutter motor 105 may be reduced in the crosswise direction. Accordingly, the printing apparatus 1 may be downsized.

The attachment portion 134 in the movable holder 130 is arranged to face the cutter motor 105 from the rearward position with respect to the cutter motor 105. In other words, the cutter motor 105 faces the movable holder 130 from the downstream side in the conveying direction. The cutter motor 105 and the movable holder 130 are relatively movable to move closer to each other. Therefore, dimensions of the area to arrange the cutter motor 105 and the movable holder 130 are reducible in the crosswise direction and the front-rear direction, and the printing apparatus 1 may further be downsized.

The printing apparatus 1 may move either the movable holder 130 or the full-cutting blade 140 by switching the rotating directions of the rotating body 150. Thus, the partial-cutting action and the full-cutting action may be switched easily in the printing apparatus 1.

The gear train 124 contains a plurality of gears that may transmit the driving force from the motor gear 105B to the rotating body 150. The gears in the gear train 124 are collectively arranged at rightward positions with respect to the output shaft 105A. The gear train 124 includes the coupling gears 125, 126, 127 and the specific gear 128, which align in this given order from top to bottom along the vertical direction. Because the gear train 124 is located rightward with respect to the output shaft 105A, in the arrangement along the vertical direction being the direction of the depth for the attachment room 6, a dimension of the area to arrange the gear train 124 may be reduced in the crosswise direction. Moreover, the specific gear 128 at the downstream end of the driving-force transmitting flow within the gear train 124 is formed integrally with the outer circumferential surface of the rotating body 150. Therefore, the dimension of the area to arrange the gear train 124 may be even more effectively reduced, and the printing apparatus 1 may be downsized even more effectively.

The groove cam 144 formed in the arm 142 of the full-cutting blade 140 is located rightward with respect to the conveyer path 12 and includes the linear cam 146. To the linear cam 146, transmitted through the pin 114 may be the driving force from the cutter motor 105. The linear cam 146 is located rightward with respect to the conveyer path 12 apart from the edge 141A and the shaft 199. Therefore, a rotation moment to be transmitted from the linear cam 146 to the full-cutting blade 140 may be increased for the separated distance, and a substantial force to fully cut the tape by the edge 141A may be achieved. Thus, the printing apparatus 1 may cut the tape by the driving force from the cutter motor 105 efficiently.

The lower end 137 of the movable holder 130 is coupled swingably with the shaft 177, and the groove cam 133 is formed in the upper end portion 138 in the movable holder 130. In other words, the lower end portion 137 is supported rotatably by the shaft 177 at the lower position with respect to a longitudinal center of the edge 103A in the extending direction of the edge 103A, while the driving force from the cutter motor 105 is transmitted to the groove cam 133 through the pin 113 at the upper position with respect to the center of the edge 103A. Because the groove cam 133 is located on the upper side with respect to the center of the edge 103A, which is the opposite side to the lower portion 137, the groove cam 133 is separated from the shaft 177 being the rotation axis of the edge 103A. Therefore, intense moment by the driving force of the motor to be transmitted to the edge 103A may be achieved, and the printing apparatus 1 may partially cut the tape by the driving force from the cutter motor 105 efficiently.

The ejection roller 220 located leftward with respect to the conveyer path 12 is rotatable about an axis extending in the vertical direction along with the rotation shaft 285A. The ejection roller 220 is movable between the nipping position and the releasing position. Therefore, the leftward area with respect to the conveyer path 12 may be efficiently used as the movable range for the ejection roller 220. In this regard, the printing apparatus 1 may be downsized.

The passage area 6A is formed in the leftward frontal area in the attachment room 6. The tape ejected through the outlet 73 frontward may pass through the passage area 6A and forwarded frontward to be away from the attachment room 6. Therefore, the tape ejected through the outlet 73 may be restrained from contacting the attachment room 6. In this regard, the tape may be conveyed correctly in the printing apparatus 1.

Although an example of carrying out the invention have been described, those skilled in the art will appreciate that there are numerous variations and permutations of the printing apparatus that fall within the spirit and scope of the disclosure as set forth in the appended claims. It is to be understood that the subject matter defined in the appended claims is not necessarily limited to the specific features or act described above. Rather, the specific features and acts described above are disclosed as example forms of implementing the claims.

For example, the cutter unit 100 may cut a tube being a printing medium. Meanwhile, the full-cutting assembly 180 may be equipped with a cutting board in place of the stationary blade 179. A leftward surface of the cutting board may face with the edge 141A along the swingable direction of the full-cutting blade 140. Moreover, the cutting board may be formed to have a dent, in which a part of the tube may enter, on the leftward surface thereof.

The conveyer path 12 may be located at a position leftward with respect to the thermal head 60 in the crosswise direction. Meanwhile, the cutter unit 100 and the ejection unit 200 may be located further leftward from the positions shown in FIG. 16. According to the embodiment described above, the rightward part of the attachment room 6 with respect to the thermal head 60 and the movable range for the movable holder 130 overlap each other in the front-rear direction. Therefore, the dimension of the area to arrange the attachment room 6 and the movable range for the movable holder 130 may be reduced in the crosswise direction. Accordingly, the printing apparatus 1 may be downsized.

For another example, the ejection unit 200 may be equipped with a plate member spreading in the front-rear direction and the vertical direction in place of the opposing roller 230. The tape may be nipped between the ejection roller 220 located at the nipping position and the plate member.

For another example, the ejection roller 220 may be movable between the nipping position and the releasing position by the user's manual operation. Meanwhile, the printing apparatus 1 may be equipped with a lever (not shown) to manipulate the ejection roller 220. The lever may be arranged inside the body 2, and the user may operate the lever when the cover 3 is open. The lever may be coupled to the ejection roller 220 through a known link assembly.

For another example, the printing apparatus 1 may not necessarily be equipped with the ejection unit 200. Without the ejection unit 200, the platen roller 65 and the conveyer roller 66 may be driven by the conveyer motor 68 to convey the tape frontward beyond the outlet 11 to eject the tape outside the printing apparatus 1.

What is claimed is:

1. A printing apparatus, comprising:

an attachment room, to which a cassette is attachable, the attachment room being a deepened section in the printing apparatus and comprising an outlet, through which a printing medium is ejected, the attachment room comprising a passage area, through which the printing medium ejected outside the cassette through the outlet travels;

a conveyer configured to convey the printing medium ejected through the outlet in a conveyer path;

a print head configured to print a character on the printing medium;

a full-cutting assembly located at a position downstream with respect to the passage area in a conveying direction, the conveying direction being a direction to convey the printing medium in the conveyer path, the full-cutting assembly being configured to cut the printing medium fully; and a partial-cutting assembly located at a position downstream with respect to the full-cutting assembly in the conveying direction, the partial-cutting assembly being configured to cut the printing medium partially, wherein the passage area forms a part of the attachment room on a first side of the conveyer path in a predetermined direction, the predetermined direction being orthogonal to a direction of depth of the attachment room and to the conveying direction;

wherein the full-cutting assembly comprises:

a stationary piece, on which the printing medium conveyed in the conveyer path is placed, the stationary piece being arranged fixedly in the full-cutting assembly on a second side of the conveyer path opposite to the first side; and a full-cutting piece comprising a first edge arranged to face the stationary piece, the first edge being configured to move in a first movable direction from a position on the first side of the conveyer path toward the stationary piece on the second side of the conveyer path, and wherein the partial-cutting assembly comprises:

a placement base located on the first side of the conveyer path, the placement base being configured to place the printing medium thereon; and a partial-cutting piece movably located on the second side of the conveyer path, the partial-cutting piece being configured move in a second movable direction, the partial-cutting piece comprising a second edge arranged to face the placement base along the second movable direction.

2. The printing apparatus according to claim 1, wherein the passage area is located in a sideward area in the attachment room closer to one end of the attachment room on the first side of the conveyer path than a center of the attachment room in the predetermined direction.

3. The printing apparatus according to claim 1, wherein the print head is located on the second side of the conveyer path in the predetermined direction.

4. The printing apparatus according to claim 1, wherein the full-cutting piece comprises a movable section, the movable section being configured to move in the first movable direction from a position on the first side of the conveyer path toward the stationary piece on the second side of the conveyer path, and wherein a length of the movable section in the first movable direction is smaller than a length of the partial-cutting piece in the second movable direction.

5. The printing apparatus according to claim 1, further comprising:

a motor; and a movable assembly configured to move the second edge toward the placement base by a driving force from the motor driving in a predetermined driving direction and to move the first edge toward the stationary piece by the driving force from the motor driving in a direction opposite to the predetermined driving direction.

6. The printing apparatus according to claim 5, wherein the motor is located on the second side of the conveyer path.

7. The printing apparatus according to claim 6, wherein the motor is arranged to face the partial-cutting piece from a position downstream with respect to the partial-cutting piece in the conveying direction.

8. The printing apparatus according to claim 5, wherein the movable assembly comprises a rotating body, the rotating body being coupled with the motor, the full-cutting piece, and the partial-cutting piece, wherein the rotating body is configured to:

rotate in a first rotating direction by the driving force from the motor driving in the predetermined driving direction, the rotating body rotating in the first rotating direction moving the partial-cutting piece selectively between the partial-cutting piece and the full-cutting piece in a direction to cause the second edge to be moved toward the placement base; and rotate in a second rotating direction opposite to the first rotating direction by the driving force from the motor driving in the direction opposite to the predetermined driving direction, the rotating body rotating in the second rotating direction moving the full-cutting piece selectively between the partial-cutting piece and the full-cutting piece in a direction to cause the first edge to be moved toward the stationary piece.

9. The printing apparatus according to claim 8, wherein the motor comprises an output shaft, to which a motor gear is fixed, wherein the printing apparatus further comprises a gear train, the gear train comprising a plurality of gears configured to transmit the driving force transmitted from the motor through the motor gear to the rotating body, the gear train being arranged along the direction of the depth of the attachment room on the second side of the conveyer path at a position farther than the output shaft form the conveyer path in the predetermined direction, and wherein a specific gear at a downstream end of a driving-force transmitting flow within the plurality of gears in the gear train is formed integrally with the rotating body.

10. The printing apparatus according to claim 9, wherein the motor is located on the second side of the conveyer path in the predetermined direction, wherein the full-cutting piece comprises a first transmitting portion, to which the driving force from the motor is transmitted, on the second side of the conveyer path in the predetermined direction.

11. The printing apparatus according to claim 5, wherein the partial-cutting piece comprises:

a supporting portion, at which the partial-cutting piece is rotatably supported in the partial-cutting assembly, on one side of the partial-cutting piece in an extending direction of the second edge with respect to a longitudinal center of the second edge; and a second transmitting portion, to which the driving force of the motor is transmitted, on a side opposite to the supporting portion in the extending direction of the second edge with respect to the longitudinal center of the second edge.

12. The printing apparatus according to claim 1, further comprising:

a specific member located on the second side of the conveyer path in the predetermined direction and at a position downstream with respect to the partial-cutting assembly in the conveying direction;

an ejection roller located on the first side of the conveyer path in the predetermined direction, the ejection roller being configured to rotate about an axis extending in parallel with the direction of the depth of the attachment room, the ejection roller being configured to move between a nipping position, in which the ejection roller nips the printing medium between the ejection roller and the specific member, and a releasing position, in which the ejection roller is separated farther on the first side from the conveyer path than the nipping position.

13. The printing apparatus according to claim 1, wherein the passage area forms a downstream end area of the attachment room in the conveying direction and a sideward end area on the first side in the predetermined direction.

14. A printing apparatus, comprising:

an attachment room, to which a cassette is attachable, the attachment room being a deepened section in the printing apparatus and comprising an outlet, through which a printing medium is ejected, the attachment room comprising a passage area, through which the printing medium ejected outside the cassette through the outlet travels;

a conveyer configured to convey the printing medium ejected through the outlet in a conveyer path;

a print head configured to print a character on the printing medium;

a full-cutting assembly located at a position downstream with respect to the passage area in a conveying direction, the conveying direction being a direction to convey the printing medium in the conveyer path, the full-cutting assembly being configured to cut the printing medium fully; and a partial-cutting assembly located at a position downstream with respect to the full-cutting assembly in the conveying direction, the partial-cutting assembly being configured to cut the printing medium partially, wherein the passage area is located in a first sideward area in the attachment room closer to one end of the attachment room than a center of the attachment room in a predetermined direction, the predetermined direction being orthogonal to a direction of depth of the attachment room and to the conveying direction;

wherein the full-cutting assembly comprises:

a stationary piece, on which the printing medium conveyed in the conveyer path is placed, the stationary piece being arranged fixedly in the full-cutting assembly in a second sideward area in the attachment room opposite to the first sideward area in the predetermined direction across the conveyer path; and a full-cutting piece comprising a first edge arranged to face the stationary piece, the first edge being configured to move from a position in the first sideward area with respect to the conveyer path toward the stationary piece in the second sideward area with respect to the conveyer path, and wherein the partial-cutting assembly comprises:

a placement base located in the first sideward area with respect to the conveyer path, the placement base being configured to place the printing medium thereon; and a partial-cutting piece movably located in the second sideward area with respect to the conveyer path, the partial-cutting piece comprising a second edge arranged to face the placement base along a movable direction of the partial-cutting piece.

* * * * *